US007739891B2

(12) United States Patent
Luckman et al.

(10) Patent No.: US 7,739,891 B2
(45) Date of Patent: Jun. 22, 2010

(54) FABRIC LAUNDERING APPARATUS ADAPTED FOR USING A SELECT RINSE FLUID

(75) Inventors: Joel A. Luckman, Benton Harbor, MI (US); Andrew Leitert, Eau Claire, MI (US); Richard A. Sunshine, Granger, IN (US); Tremitchell L. Wright, Elkhart, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 729 days.

(21) Appl. No.: 10/957,485

(22) Filed: Oct. 1, 2004

(65) Prior Publication Data

US 2005/0092033 A1 May 5, 2005

Related U.S. Application Data

(63) Continuation of application No. 10/699,159, filed on Oct. 31, 2003, now abandoned.

(51) Int. Cl.
*D06F 15/00* (2006.01)

(52) U.S. Cl. ..... 68/124

(58) Field of Classification Search ..... 68/124
See application file for complete search history.

(56) References Cited

U.S. PATENT DOCUMENTS

| | | | |
|---|---|---|---|
| 2,107,227 | A | 2/1938 | Woodin |
| D120,681 | S | 5/1940 | Sutton |
| 2,629,242 | A | 2/1953 | Hallander |
| 2,987,902 | A | 6/1961 | Mack |
| 3,085,415 | A | 4/1963 | Gosnell |
| 3,103,112 | A | 9/1963 | Behrens et al. |
| 3,125,106 | A | 3/1964 | Brucken et al. |
| 3,163,028 | A | 12/1964 | De Pas et al. |
| 3,225,572 | A | 12/1965 | Robbins et al. |
| 3,232,335 | A | 2/1966 | Kalbfleisch |
| 3,246,493 | A | 4/1966 | Oles |
| 3,266,166 | A | 8/1966 | Heinrich |
| 3,269,539 | A | 8/1966 | Brucken et al. |
| 3,386,796 | A | 6/1968 | Videen |
| 3,402,576 | A | 9/1968 | Krupsky |
| 3,410,118 | A | 11/1968 | Dickey |
| 3,423,311 | A | 1/1969 | Richard Hetherinton, et al. |
| 3,583,181 | A | 6/1971 | Brillet |
| 3,674,650 | A | 7/1972 | Fine |

(Continued)

FOREIGN PATENT DOCUMENTS

| | | |
|---|---|---|
| EP | 0182583 | 11/1985 |

(Continued)

*Primary Examiner*—Michael Cleveland
*Assistant Examiner*—Samuel A Waldbaum
(74) *Attorney, Agent, or Firm*—Clifton G. Green; Benesch, Friedlander, Coplan & Aronoff LLP

(57) ABSTRACT

A non-aqueous laundering machine for laundering fabric with a non-aqueous wash liquor and a select rinse fluid. The non-aqueous laundering machine includes a container for a fabric load and means for the controlled application of a non-aqueous wash liquor to the fabric load, the removal of part of the non-aqueous wash liquor from the fabric load, and application of a select rinse fluid to the fabric load as well as means for applying mechanical energy to the fabric load.

36 Claims, 13 Drawing Sheets

U.S. PATENT DOCUMENTS

| | | | | |
|---|---|---|---|---|
| 3,691,649 | A | | 9/1972 | Pigors, Ernst |
| 3,733,267 | A | | 5/1973 | Haase et al. |
| 3,805,404 | A | * | 4/1974 | Gould ..... 34/75 |
| 3,809,924 | A | | 5/1974 | Grunow et al. |
| 3,930,998 | A | | 1/1976 | Knopp et al. |
| 4,004,048 | A | | 1/1977 | Jackson |
| 4,032,927 | A | | 6/1977 | Goshima |
| 4,042,498 | A | | 8/1977 | Kennedy |
| 4,045,174 | A | | 8/1977 | Fuhring et al. |
| 4,046,700 | A | | 9/1977 | Glover |
| 4,121,009 | A | | 10/1978 | Chakrabarti |
| 4,153,590 | A | | 5/1979 | Mueller |
| 4,154,003 | A | * | 5/1979 | Muller ..... 34/469 |
| 4,169,856 | A | | 10/1979 | Cocuzza et al. |
| 4,184,950 | A | | 1/1980 | Bixby |
| 4,186,047 | A | | 1/1980 | Salmon |
| 4,235,600 | A | | 11/1980 | Capella |
| 4,247,330 | A | | 1/1981 | Sanders, Jr. |
| 4,252,546 | A | | 2/1981 | Krugmann |
| 4,331,525 | A | | 5/1982 | Huba et al. |
| 4,388,437 | A | | 6/1983 | Ona |
| 4,395,488 | A | | 7/1983 | Rowe |
| 4,420,398 | A | | 12/1983 | Castino |
| 4,421,794 | A | | 12/1983 | Kinsley, Jr. |
| 4,434,196 | A | | 2/1984 | Robinson et al. |
| 4,444,625 | A | | 4/1984 | Smith |
| 4,457,858 | A | | 7/1984 | Saran |
| 4,499,621 | A | | 2/1985 | Gasser |
| 4,513,590 | A | | 4/1985 | Fine |
| 4,539,093 | A | | 9/1985 | Friedman et al. |
| 4,595,506 | A | | 6/1986 | Kneer |
| 4,601,181 | A | | 7/1986 | Privat |
| 4,610,785 | A | | 9/1986 | Russell |
| 4,621,438 | A | * | 11/1986 | Lanciaux ..... 34/77 |
| 4,622,039 | A | | 11/1986 | Merenda |
| 4,625,432 | A | | 12/1986 | Baltes |
| 4,636,328 | A | | 1/1987 | Flynn et al. |
| 4,664,754 | A | | 5/1987 | Caputi et al. |
| 4,665,929 | A | | 5/1987 | Helm |
| 4,678,587 | A | | 7/1987 | Voinche et al. |
| 4,682,424 | A | * | 7/1987 | Irving ..... 34/621 |
| 4,685,930 | A | | 8/1987 | Kasprzak |
| 4,708,775 | A | | 11/1987 | McGregor et al. |
| 4,708,807 | A | | 11/1987 | Kemerer |
| 4,755,261 | A | | 7/1988 | McCord et al. |
| 4,761,209 | A | | 8/1988 | Bonaventura et al. |
| 4,767,537 | A | | 8/1988 | Davis |
| 4,769,921 | A | | 9/1988 | Kabakov |
| 4,790,910 | A | | 12/1988 | Havlik |
| 4,802,253 | A | | 2/1989 | Hagiwara |
| 4,808,319 | A | | 2/1989 | McNally et al. |
| 4,818,297 | A | | 4/1989 | Holzmiiller et al. |
| 4,830,710 | A | | 5/1989 | Thompson |
| 4,834,003 | A | | 5/1989 | Reischl et al. |
| 4,851,123 | A | | 7/1989 | Kmishra |
| 4,857,150 | A | | 8/1989 | Rival |
| 4,869,872 | A | | 9/1989 | Baltes |
| 4,879,888 | A | | 11/1989 | Suissa |
| 4,880,533 | A | | 11/1989 | Hondulas |
| 4,904,390 | A | | 2/1990 | Schweighofer et al. |
| 4,911,761 | A | | 3/1990 | McConnell |
| 4,912,793 | A | | 4/1990 | Hagiwara |
| 4,919,839 | A | | 4/1990 | Durbut |
| 4,947,983 | A | | 8/1990 | Jost |
| 4,961,753 | A | | 10/1990 | Donkers et al. |
| 4,980,030 | A | | 12/1990 | Johnson et al. |
| 4,984,318 | A | | 1/1991 | Coindreau-Palau |
| 4,999,398 | A | | 3/1991 | Graiver et al. |
| 5,004,000 | A | | 4/1991 | Berruex |
| 5,028,326 | A | | 7/1991 | Littler et al. |
| 5,043,075 | A | | 8/1991 | Dietmar et al. |
| 5,050,259 | A | | 9/1991 | Tsubaki et al. |
| 5,054,210 | A | | 10/1991 | Schumacher |
| 5,056,174 | A | | 10/1991 | Hagiwara |
| 5,082,503 | A | | 1/1992 | Slugs |
| 5,091,105 | A | | 2/1992 | Madore et al. |
| 5,093,031 | A | | 3/1992 | Login et al. |
| 5,104,419 | A | | 4/1992 | Funk |
| 5,104,545 | A | | 4/1992 | Means et al. |
| 5,106,507 | A | | 4/1992 | Klock et al. |
| 5,112,358 | A | | 5/1992 | Deal |
| 5,116,426 | A | | 5/1992 | Asano et al. |
| 5,116,473 | A | | 5/1992 | Bostjancic |
| 5,118,322 | A | | 6/1992 | Wasinger et al. |
| 5,133,802 | A | | 7/1992 | Maekawa et al. |
| 5,135,656 | A | | 8/1992 | Means et al. |
| 5,143,579 | A | | 9/1992 | Field et al. |
| 5,146,693 | A | * | 9/1992 | Dottor et al. ..... 34/77 |
| 5,151,026 | A | | 9/1992 | Anderson et al. |
| 5,154,854 | A | | 10/1992 | Zabotto et al. |
| 5,164,030 | A | | 11/1992 | Casper |
| 5,167,821 | A | | 12/1992 | Tanbo et al. |
| 5,173,200 | A | | 12/1992 | Kellett |
| 5,193,560 | A | | 3/1993 | Tanaka |
| 5,199,125 | A | | 4/1993 | Otto |
| 5,212,272 | A | | 5/1993 | Sargent et al. |
| 5,232,476 | A | | 8/1993 | Grant |
| 5,240,507 | A | | 8/1993 | Gray |
| 5,248,393 | A | | 9/1993 | Schumacher et al. |
| 5,256,557 | A | | 10/1993 | Shetty et al. |
| 5,268,150 | A | | 12/1993 | Burkitt |
| 5,269,958 | A | | 12/1993 | de Jager |
| 5,273,589 | A | | 12/1993 | Griswold et al. |
| 5,284,029 | A | | 2/1994 | Keuper et al. |
| 5,287,985 | A | | 2/1994 | Hatayama |
| 5,288,420 | A | | 2/1994 | Mandy |
| 5,288,422 | A | | 2/1994 | Basu |
| 5,290,473 | A | | 3/1994 | Basu |
| 5,294,644 | A | | 3/1994 | Login et al. |
| 5,300,154 | A | | 4/1994 | Ferber et al. |
| 5,300,197 | A | | 4/1994 | Mitani et al. |
| 5,304,253 | A | | 4/1994 | Grant |
| 5,304,320 | A | | 4/1994 | Barthelemy et al. |
| 5,308,562 | A | | 5/1994 | Wohlfahrt-Laymann |
| 5,315,727 | A | | 5/1994 | Lee |
| 5,316,690 | A | | 5/1994 | Li |
| 5,320,683 | A | | 6/1994 | Samejima |
| 5,334,258 | A | | 8/1994 | Osano |
| 5,340,443 | A | | 8/1994 | Heinio et al. |
| 5,340,464 | A | | 8/1994 | Mickas |
| 5,342,405 | A | | 8/1994 | Duncan |
| 5,344,527 | A | | 9/1994 | Mickas |
| 5,346,588 | A | | 9/1994 | Sixta et al. |
| 5,354,428 | A | | 10/1994 | Clark et al. |
| 5,354,480 | A | | 10/1994 | Robinson et al. |
| 5,360,547 | A | | 11/1994 | Cockett et al. |
| 5,368,649 | A | | 11/1994 | Tsukazaki |
| 5,377,705 | A | | 1/1995 | Smith |
| 5,392,480 | A | | 2/1995 | Ishihara |
| 5,404,732 | A | | 4/1995 | Kim |
| 5,405,542 | A | | 4/1995 | Trinh et al. |
| 5,405,767 | A | | 4/1995 | Shetty |
| 5,407,446 | A | | 4/1995 | Sando |
| 5,419,849 | A | | 5/1995 | Fields |
| 5,421,049 | A | | 6/1995 | Hendren |
| 5,423,921 | A | | 6/1995 | Saal |
| 5,426,955 | A | | 6/1995 | Modahl |
| 5,427,858 | A | | 6/1995 | Nakamura et al. |
| 5,431,827 | A | | 7/1995 | Tatch |
| 5,439,817 | A | | 8/1995 | Shetty et al. |
| 5,443,747 | A | | 8/1995 | Inada et al. |
| 5,447,171 | A | | 9/1995 | Shibano |
| 5,456,856 | A | | 10/1995 | Flaningam et al. |
| 5,460,018 | A | | 10/1995 | Werner |

5,463,819 A 11/1995 Komori
5,467,492 A 11/1995 Chao et al.
5,480,572 A 1/1996 Minor
5,488,842 A 2/1996 Nishioka et al.
5,490,894 A 2/1996 Matsuhisa
5,492,138 A 2/1996 Taricco
5,493,743 A 2/1996 Schneider
5,494,526 A 2/1996 Paranjpe
5,494,600 A 2/1996 Surutzidis et al.
5,498,266 A * 3/1996 Takagawa et al. ..... 8/142
5,500,096 A 3/1996 Yuan
5,501,811 A 3/1996 Flaningam et al.
5,503,681 A 4/1996 Inada et al. ..... 134/1
5,503,756 A 4/1996 Corona, III et al.
5,504,954 A 4/1996 Joo
5,505,985 A 4/1996 Nakamura et al.
5,511,264 A 4/1996 Nishioka et al.
5,518,624 A 5/1996 Filson et al.
5,524,358 A 6/1996 Matz
5,536,327 A 7/1996 Kaiser
5,536,374 A 7/1996 Spring
5,537,754 A 7/1996 Bachmann et al.
5,538,025 A 7/1996 Gray
5,538,746 A 7/1996 Levy
5,555,641 A 9/1996 Lee
5,591,236 A 1/1997 Roetker
5,593,598 A 1/1997 McGinness et al.
5,604,145 A 2/1997 Hashizume et al.
5,605,882 A 2/1997 Klug et al.
5,617,737 A 4/1997 Christensen et al.
5,622,630 A 4/1997 Romano
5,625,965 A 5/1997 Blissett et al.
5,637,336 A 6/1997 Kannenberg et al.
5,644,158 A 7/1997 Fujii et al.
5,645,727 A 7/1997 Bhave et al.
5,649,785 A 7/1997 Djerf et al.
5,653,873 A 8/1997 Grossman
5,656,246 A 8/1997 Patapoff et al.
5,668,102 A 9/1997 Severns et al.
5,676,005 A 10/1997 Balliett
5,689,848 A 11/1997 Saal et al.
5,712,240 A 1/1998 Tyerech et al.
5,759,209 A 6/1998 Adler
5,765,403 A 6/1998 Lincoln et al.
5,773,403 A 6/1998 Hijino et al.
5,776,351 A 7/1998 McGinness et al.
5,776,362 A 7/1998 Sato et al.
5,787,537 A 8/1998 Mannillo
5,789,368 A 8/1998 You et al.
5,799,612 A 9/1998 Page
5,806,120 A 9/1998 McEachem
5,814,498 A 9/1998 Mani et al.
5,814,592 A 9/1998 Kahn et al.
5,814,595 A 9/1998 Flynn et al.
5,824,632 A 10/1998 Flaningam et al.
5,840,675 A 11/1998 Yeazell
5,846,435 A 12/1998 Haase
5,849,197 A 12/1998 Taylor et al.
5,853,593 A 12/1998 Miller
5,858,240 A 1/1999 Tardowski et al.
5,865,851 A 2/1999 Sidoti et al.
5,865,852 A 2/1999 Berndt
5,868,937 A 2/1999 Back et al.
5,876,461 A 3/1999 Racette et al. ..... 8/137
5,876,685 A 3/1999 Krulik et al.
5,885,366 A 3/1999 Umino et al.
5,888,250 A 3/1999 Hayday et al. ..... 8/142
5,893,979 A 4/1999 Held
5,894,061 A 4/1999 Ladouceur
5,904,737 A 5/1999 Preston et al.
5,906,750 A 5/1999 Haase
5,912,408 A 6/1999 Trinh et al.
5,914,041 A 6/1999 Chancellor
5,925,469 A 7/1999 Gee
5,925,611 A 7/1999 Flynn et al.
5,935,441 A 8/1999 O'Neill et al.
5,935,525 A 8/1999 Lincoln et al.
5,942,007 A 8/1999 Berndt et al.
5,954,869 A 9/1999 Elfersy et al.
5,955,394 A 9/1999 Kelly
5,958,240 A 9/1999 Hoel
5,959,014 A 9/1999 Liebeskind et al.
5,960,501 A 10/1999 Burdick
5,960,649 A 10/1999 Burdick
5,962,390 A 10/1999 Flynn et al.
5,972,041 A 10/1999 Smith et al.
5,977,040 A 11/1999 Inada et al.
5,985,810 A 11/1999 Inada et al.
6,006,387 A 12/1999 Cooper
6,010,621 A 1/2000 Pattee
6,013,683 A 1/2000 Hill
6,027,651 A 2/2000 Cash
6,029,479 A 2/2000 Pattee
6,042,617 A 3/2000 Berndt
6,042,618 A 3/2000 Berndt
6,045,588 A 4/2000 Estes et al. ..... 8/142
6,056,789 A 5/2000 Berndt
6,059,845 A 5/2000 Berndt
6,059,971 A 5/2000 Vit et al.
6,060,108 A 5/2000 Burd et al.
6,063,135 A 5/2000 Berndt et al.
6,063,748 A 5/2000 Flynn et al.
6,086,635 A 7/2000 Berndt et al.
6,098,306 A 8/2000 Ramsey
6,113,815 A 9/2000 Elfersy
6,115,862 A 9/2000 Cooper
6,120,587 A 9/2000 Elfersy
6,136,223 A 10/2000 Collins
6,136,766 A 10/2000 Inada et al.
6,149,980 A 11/2000 Behr et al.
6,156,074 A 12/2000 Hayday et al. ..... 8/142
6,159,376 A 12/2000 Lahti
6,159,917 A 12/2000 Baran
6,168,714 B1 1/2001 Ilias et al.
6,171,346 B1 1/2001 Yeazell et al.
6,177,399 B1 1/2001 Mei et al.
6,190,556 B1 2/2001 Uhlinger
6,207,634 B1 3/2001 Meyer et al.
6,216,302 B1 4/2001 Preston et al.
6,217,771 B1 4/2001 Boyle et al.
6,221,944 B1 4/2001 Liebeskind
6,238,516 B1 5/2001 Watson et al.
6,238,736 B1 5/2001 Smith
6,239,097 B1 5/2001 Wilson
6,241,779 B1 6/2001 Collins
6,241,786 B1 6/2001 Zarges et al.
6,254,838 B1 7/2001 Goede
6,254,932 B1 7/2001 Smith
6,258,130 B1 7/2001 Murphy ..... 8/142
6,258,276 B1 7/2001 Mika et al.
6,261,460 B1 7/2001 Benn et al.
6,269,667 B1 8/2001 Back
6,273,919 B1 8/2001 Hayday ..... 8/142
6,274,540 B1 8/2001 Scheibel et al.
6,277,804 B1 8/2001 Kahn et al.
6,281,187 B1 8/2001 Smerznak
6,288,018 B1 9/2001 Flynn et al.
6,299,779 B1 10/2001 Pattee
6,309,425 B1 10/2001 Murphy ..... 8/142
6,309,752 B1 10/2001 Dams et al.
6,310,029 B1 10/2001 Kilgour et al. ..... 510/466
6,312,476 B1 11/2001 Perry et al.
6,319,406 B1 11/2001 Freshour et al.
6,327,731 B2 12/2001 Back
6,348,441 B1 2/2002 Aiken et al.
6,350,377 B1 2/2002 Kollmar et al.

| | | | | |
|---|---|---|---|---|
| 6,365,051 | B1 | 4/2002 | Bader | |
| 6,379,547 | B1 | 4/2002 | Larsson | |
| 6,384,008 | B1 | 5/2002 | Parry | |
| 6,387,186 | B1 | 5/2002 | Reisig et al. | |
| 6,387,241 | B1 | 5/2002 | Murphy et al. | |
| 6,398,840 | B1 | 6/2002 | Orta-Castro et al. | |
| 6,399,357 | B1 | 6/2002 | Winge | |
| 6,402,956 | B1 | 6/2002 | Andou et al. | |
| 6,416,668 | B1 | 7/2002 | Al-Samadi | |
| 6,423,230 | B2 | 7/2002 | Ilias et al. | |
| 6,451,066 | B2 * | 9/2002 | Estes et al. | 8/142 |
| 6,475,968 | B1 | 11/2002 | Murphy et al. | |
| 6,479,719 | B1 | 11/2002 | Kotwica et al. | |
| 6,552,090 | B1 | 4/2003 | Behr et al. | |
| 6,558,432 | B2 | 5/2003 | Schulte et al. | 8/142 |
| 6,591,638 | B2 | 7/2003 | Estes et al. | |
| 6,653,512 | B1 | 11/2003 | Behr et al. | |
| 6,670,317 | B2 | 12/2003 | Severns et al. | |
| 6,691,536 | B2 | 2/2004 | Severns et al. | |
| 6,734,153 | B2 | 5/2004 | Scheper | |
| 6,736,859 | B2 | 5/2004 | Racette et al. | 8/142 |
| 6,743,262 | B1 | 6/2004 | Behr et al. | |
| 6,746,617 | B2 | 6/2004 | Radomyselski et al. | |
| 6,755,871 | B2 | 6/2004 | Damaso et al. | 8/137 |
| 6,766,670 | B2 | 7/2004 | Estes et al. | |
| 6,770,615 | B1 | 8/2004 | Aouad et al. | |
| 6,811,811 | B2 | 11/2004 | France et al. | |
| 6,828,295 | B2 | 12/2004 | Deak et al. | |
| 6,840,069 | B2 | 1/2005 | France et al. | |
| 6,855,173 | B2 | 2/2005 | Ehrnsperger et al. | |
| 6,860,998 | B1 | 3/2005 | Wilde | |
| 6,890,892 | B2 | 5/2005 | Scheper et al. | |
| 6,894,014 | B2 | 5/2005 | Deak et al. | |
| 6,898,951 | B2 | 5/2005 | Severns et al. | |
| 7,033,985 | B2 | 4/2006 | Noyes et al. | |
| 2001/0042275 | A1 | 11/2001 | Estes et al. | |
| 2001/0054202 | A1 | 12/2001 | Severns et al. | |
| 2002/0004950 | A1 | 1/2002 | Burns et al. | |
| 2002/0004952 | A1 | 1/2002 | Deak et al. | |
| 2002/0004995 | A1 | 1/2002 | France et al. | |
| 2002/0007519 | A1 | 1/2002 | Noyes et al. | |
| 2002/0010964 | A1 | 1/2002 | Deak et al. | |
| 2002/0010965 | A1 | 1/2002 | Schulte et al. | |
| 2002/0013234 | A1 | 1/2002 | Severns et al. | |
| 2002/0017493 | A1 | 2/2002 | Ehrnsperger et al. | |
| 2002/0029427 | A1 | 3/2002 | Severns et al. | |
| 2002/0038480 | A1 | 4/2002 | Deak et al. | |
| 2002/0056163 | A1 | 5/2002 | Estes | |
| 2002/0056164 | A1 | 5/2002 | Estes et al. | |
| 2002/0110926 | A1 * | 8/2002 | Kopf-Sill et al. | 436/516 |
| 2002/0133886 | A1 * | 9/2002 | Severns et al. | 8/142 |
| 2003/0037809 | A1 * | 2/2003 | Favaro | 134/58 D |
| 2003/0046963 | A1 | 3/2003 | Scheper et al. | |
| 2003/0084588 | A1 | 5/2003 | France et al. | 34/245 |
| 2003/0092592 | A1 | 5/2003 | Bargaje et al. | |
| 2003/0097718 | A1 | 5/2003 | Evers et al. | |
| 2003/0196277 | A1 | 10/2003 | Hallman et al. | |
| 2003/0204917 | A1 | 11/2003 | Estes et al. | |
| 2003/0226214 | A1 | 12/2003 | Radomyselski et al. | |
| 2004/0088795 | A1 | 5/2004 | Orchowski et al. | |
| 2004/0088846 | A1 | 5/2004 | Murphy et al. | |
| 2004/0117919 | A1 | 6/2004 | Conrad et al. | 8/137 |
| 2004/0129032 | A1 | 7/2004 | Severns et al. | |
| 2004/0139555 | A1 | 7/2004 | Conrad | |
| 2005/0000897 | A1 | 1/2005 | Radomyselski et al. | |
| 2005/0037938 | A1 | 2/2005 | Reinhoudt et al. | |
| 2005/0043196 | A1 | 2/2005 | Wright et al. | |
| 2005/0071928 | A1 | 4/2005 | Wright et al. | |
| 2005/0076453 | A1 | 4/2005 | Lucas et al. | |
| 2005/0091755 | A1 | 5/2005 | Conrad et al. | |
| 2005/0091756 | A1 | 5/2005 | Wright | |
| 2005/0091757 | A1 | 5/2005 | Luckman et al. | |
| 2005/0092033 | A1 | 5/2005 | Luckman et al. | |
| 2005/0096242 | A1 | 5/2005 | Luckman et al. | |
| 2005/0096243 | A1 | 5/2005 | Luckman et al. | |
| 2005/0126606 | A1 | 6/2005 | Goedhart et al. | |
| 2005/0132502 | A1 | 6/2005 | Goldoni | |
| 2005/0133462 | A1 | 6/2005 | Goldini | |
| 2005/0150059 | A1 | 7/2005 | Luckman et al. | |
| 2005/0155393 | A1 | 7/2005 | Wright et al. | |
| 2005/0222002 | A1 | 10/2005 | Luckman et al. | |
| 2005/0257812 | A1 | 11/2005 | Wright et al. | |
| 2005/0263173 | A1 | 12/2005 | Luckman et al. | |

FOREIGN PATENT DOCUMENTS

| | | |
|---|---|---|
| EP | 0182583 | 7/1991 |
| EP | 0246007 | 3/1992 |
| EP | 6233898 | 8/1994 |
| EP | 0707060 | 7/1998 |
| EP | 1041189 | 10/2000 |
| EP | 1290259 | 3/2003 |
| EP | 1528138 | 10/2004 |
| EP | 1528139 | 10/2004 |
| EP | 1528140 | 10/2004 |
| EP | 1528141 | 10/2004 |
| EP | 1536052 | 10/2004 |
| EP | 1528138 | 5/2005 |
| EP | 1528139 | 5/2005 |
| EP | 153052 | 6/2005 |
| GB | 1002318 | 8/1965 |
| GB | 1500801 | 2/1975 |
| JP | 405064521 | 3/1993 |
| JP | 06233898 | 8/1994 |
| WO | WO 98/06815 | 2/1998 |
| WO | WO98/06818 | 2/1998 |
| WO | WO 99/14175 | 3/1999 |
| WO | WO 01/06051 | 1/2001 |
| WO | WO 01/34613 | 5/2001 |
| WO | WO 01/44256 | 6/2001 |
| WO | WO 01/94675 | 12/2001 |
| WO | WO 01/94677 | 12/2001 |
| WO | WO 01/94680 | 12/2001 |
| WO | WO 01/94683 | 12/2001 |
| WO | WO 01/94685 | 12/2001 |
| WO | WO0194675 | 12/2001 |

* cited by examiner

FABRIC LAUNDERING APPARATUS ADAPTED FOR USING A SELECT RINSE FLUID

CROSS-REFERENCE

This application is a Continuation-in-part of application Ser. No. 10/699,159, filed Oct. 31, 2003 now abandoned, and related to patent application docket No. US20040171, entitled "A Method for Laundering Fabric with a Non-Aqueous Working Fluid Using a Select Rings Fluid"; US20040173, entitled "Method and Apparatus Adapted for Recovery and Reuse of Select Rinse Fluid in a Non-Aqueous Wash Apparatus; and US20040174, "Fabric Laundering Using a Select Rinse Fluid and Wash Fluids", filed concurrently herewith.

TECHNICAL FIELD OF THE INVENTION

The invention relates to a non-aqueous laundering machine, methods of using the machine, methods of rinsing, drying and recovery as well as apparatuses for the same.

BACKGROUND OF THE INVENTION

As defined by Perry's Chemical Engineers' Handbook, 7th edition, liquid extraction is a process for separating components in solution by their distribution between two immiscible phases. Such a process is also referred to as Solvent Extraction, but Solvent Extraction also implies the leaching of a soluble substance from a solid.

The present invention relates to a program of events and ingredients that make it possible to produce a non-aqueous laundering machine that is self contained, automatic and relatively compact that can be used in the home as well as commercially. The machine would offer the consumer the ability not only to launder their traditional fabrics (cotton, polyesters, etc.) at home, but also have the ability to handle delicate fabrics such as dry-clean only fabrics as well. There have been numerous attempts at making a non-aqueous laundering system; however, there have been many limitations associated with such attempts.

Traditional dry-cleaning solvents such as perchloroethylene are not feasible for in-home applications because they suffer from the disadvantage of having perceived environmental and health risks. Fluorinated solvents such as hydrofluoroethers have been posed as potential solvents for such an application. These solvents are environmentally friendly and have high vapor pressures leading to fast drying times, but these solvents don't currently provide the cleaning needed in such a system.

Other solvents have been listed as potential fluids for such an application. Siloxane-based materials, glycol ethers and hydrocarbon-based solvents all have been investigated. Typically, these solvents are combustible fluids but the art teaches some level of soil removal. However, since these solvents are combustible and usually have low vapor pressures, it would be difficult to dry with traditional convection heating systems. The solvents have low vapor pressures making evaporation slow thus increasing the drying time needed for such systems. Currently, the National Fire Protection Association has product codes associated for flammable solvents. These safety codes limit the potential heat such solvents could see or the infrastructure needed to operate the machine. In traditional washer/dryer combination machines, the capacity or load size is limited based on the drying rate. However, with the present invention, the capacity of the machines will be more dependent upon the size of the drum than the size of the load.

The present invention uses some of these aforementioned solvents to clean fabrics without the drying problems associated with these solvents. This is accomplished by using a select rinse fluid that solves many of these drying problems.

U.S. Pat. No. 5,498,266 describes a method using petroleum-based solvent vapors wherein perfluorocarbon vapors are admixed with petroleum solvent vapors to remove the solvents from the fabrics and provide improvements in safety by reducing the likelihood of ignition or explosion of the vapors. However, the long-term stability of these mixtures is unknown but has the potential of separating due to dissociating the separate components.

U.S. Pat. No. 6,045,588 describes a method for washing, drying and recovering using an inert working fluid. Additionally, this application teaches the use of liquid extraction with an inert working fluid along with washing and drying. This new patent application differs from U.S. Pat. No. 6,045,588 in that it describes preferred embodiments to minimize the amount of rinse fluid needed as well as recovery methods, apparatuses and sequences not previously described.

U.S. Pat. No. 6,558,432 describes the use of a pressurized fluid solvent such as carbon dioxide to avoid the drying issues. In accordance with these methods, pressures of about 500 to 1000 psi are required. These conditions would result in larger machines than need be for such an operation. Additionally, this is an immersion process that may require more than one rinse so additional storage capacity is needed.

US20030084588 describes the use of a high vapor pressure, above 3-mm Hg, co-solvent that is subjected to lipophilic fluid containing fabric articles. While a high vapor pressure solvent may be preferred in such a system, US20030084588 fails to disclose potential methods of applying the fluid, when the fluid should be used and methods minimizing the amount of fluid needed. Finally, this patent fails to identify potential recovery strategies for the high vapor pressure co-solvent.

Various perfluorocarbons materials have been employed alone or in combination with cleaning additives for washing printed circuit boards and other electrical substrates, as described for example in U.S. Pat. No. 5,503,681. Spray cleaning of rigid substrates is very different from laundering soft fabric loads. Moreover, cleaning of electrical substrates is performed in high technology manufacturing facilities employing a multi-stage that is not readily adaptable to such a cleaning application.

The first object of the present invention is to devise a complete sequence of non-aqueous laundering operations using a combination of materials that can be economically separated and used over and over again in a self contained non-aqueous laundering machine.

It is a further object of the invention to describe specific processes for introducing the select rinse fluid.

It is an object of the invention to describe techniques and methods for minimizing the amount of select rinse fluid needed and the time that the select rinse fluid should be in contact with the working fluid and fabric articles.

It is a further object of the invention to describe a low temperature drying process that would result in improved fabric care and lower energy requirements for such a non-aqueous laundering machine.

It is still another object of the invention to disclose the advantage of increasing the size of the load to be dried without significantly increasing the drying time as is common with traditional aqueous-based machines and non-aqueous machines using some of these methods.

It is another object of the invention to describe recovery methods and techniques not only for the select rinse fluid, but also additionally for the working fluid and wash liquor.

It is a further object of the invention to describe apparatuses designed to complete the select rinse fluid application, low temperature drying and recovery methods.

It is a further object of the invention that the soils removed are concentrated and disposed of in an environmentally friendly manner.

It is a further object that the materials used are all of a type that avoids explosion and manages flammability hazards.

Further objects and advantages of the invention will become apparent to those skilled in the art to which this invention relates from the following description of the drawings and preferred embodiments that follow:

SUMMARY OF THE INVENTION

The present invention provides to a non-aqueous laundering machine for laundering fabric with a non-aqueous wash liquor and a select rinse fluid.

In one aspect of the present invention, an automatic fabric laundering apparatus includes a perforated drum for containing fabrics to be cleaned; first means for supplying a working fluid to said drum; second means for spinning the drum; third means for applying a select rinse fluid to the fabrics such that the select rinse fluid flows through the fabric; fourth means for flowing a drying gas into the container under conditions to vaporize fluids in the fabric; and automatic control means for regulating the times and conditions necessary for the above means to cycle and leave the fabric in essentially a dry condition.

In another aspect of the present invention, a fabric laundering apparatus has a container to hold fabric; storage and dispensing systems for storing and dispensing working fluid, rinse fluid and washing additives; and a recovery system for recovering working fluid and rinse fluid for reuse.

In yet another aspect of the present invention, a fabric laundering apparatus includes a container to hold fabric; a storage and delivery system for the working fluid; a second storage and delivery system for the rinse fluid; a heater to heat fabric to remove fluids from the fabric; and a controller responsive to operate the heater.

DETAILED DESCRIPTION OF THE INVENTION

Figure 1:
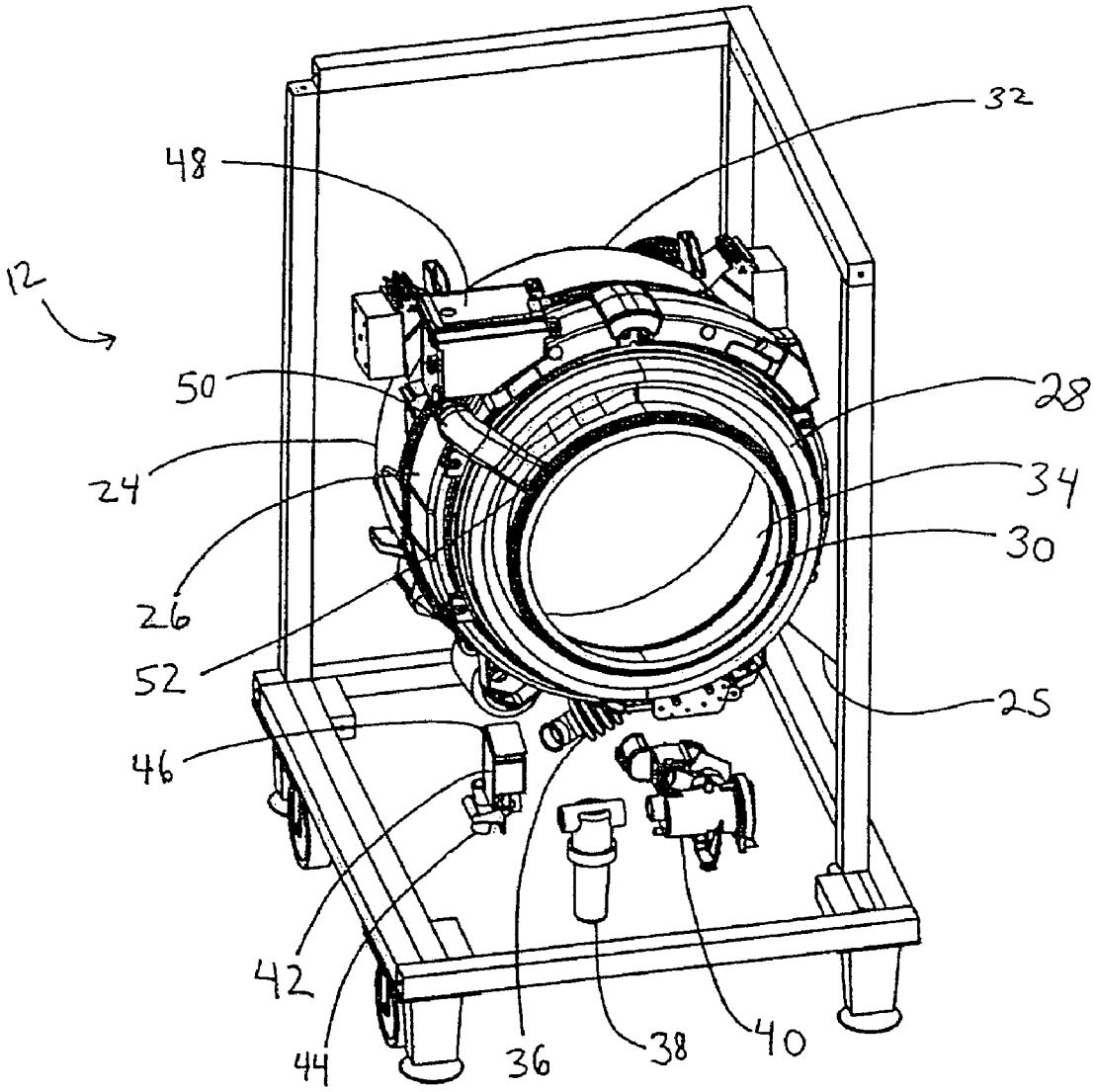
FIG. 1 depicts a wash unit apparatus in which the present invention can be completed.

Modifications of the machine shown in U.S. patent application Ser. No. 10/699,262, "Non-Aqueous Washing Apparatus", filed Oct. 31, 2003 now U.S. Pat. No. 7,043,262, has been used to test the efficacy of the washing and recovery operations depicted in the drawings and the specification should be incorporated herein for reference.

FIG. 1 depicts an embodiment of the wash unit 12, without the outer housing. Shown is a tub assembly 24, which includes a wash chamber 26 that is adapted to receive the contents to be washed, such as a fabric load (not shown). The tub assembly is connected to an outer structure via various suspension arms 25. The wash chamber 26 also includes a flexible boot 28 that circumferentially surrounds the opening 30 of the wash chamber 26. The boot 28 is adapted to provide a seal around the wash chamber 26 opening and also provide a conduit to the access door. The wash chamber 26 also includes a rear section 32. Inside the wash chamber 26 is a basket 34 that includes one or more perforations. The perforations may be uniformly dispersed about the basket 34, randomly dispersed, or dispersed in some other fashion. The perforations provide fluid communication between the interior of the wash basket 34 to the wash chamber 26.

FIG. 1 also demonstrates a wash unit re-circulation system. In various embodiments of the invention described herein, wash liquor may be extracted from the wash chamber 26 and re-circulated back into the wash chamber 26. One embodiment is now described. The wash chamber 26 includes a drain outlet (not shown) that is in fluid communication with a wash chamber sump 36. The wash chamber sump 36 may be designed to have a large volume capacity so that it may store the entire volume of wash liquor introduced into the wash chamber 26. For example, in the event of a system failure, the wash liquor can drain into the chamber sump 36. The drain outlet (not shown) may also include a gate or cover that can be sealed. Accordingly, in the event of a system failure, the wash liquor contents may be drained into the sump 36, the drain outlet closed, and the fabric contents can be removed.

A simple electric coil heater (not shown) may be optionally associated with sump 36 so that the wash liquor in the sump may be heated. In various embodiments, it may be desirable to re-circulate heated wash liquor back into the fabric so that the fabric maintains an elevated temperature, or because various washing adjuvant(s) work—or work better—in a heated environment. The heater may also heat the wash liquor to deactivate adjuvant(s) in the wash liquor. Accordingly, the heater may be programmed to activate or deactivate based on the intended use. The heating means is not limited to electric coil heaters.

Wash chamber sump 36 is in fluid communication with a filter 38, such as a coarse lint filter, that is adapted to filter out large particles, such as buttons, paper clips, lint, food, etc. The filter 38 may be consumer accessible to provide for removal, cleaning, and/or replacement.

Accordingly, it may be desirable to locate the filter 38 near the front side of the wash unit 12 and preferably near the bottom so that any passive drainage occurs into the sump 36 and the filter 38. In another embodiment, the filter 38 may also be back-flushed to the reclamation unit 14 so that any contents may be removed from the reclamation unit 14. In another embodiment, the filter can be back-flushed within the wash unit to the sump and then pumped to the reclamation unit. In this regard, consumer interaction with the filter 38 can be intentionally limited.

Filtered wash liquor may then be passed to the reclamation unit 14 for further processing or may be passed to a re-circulation pump 40. Although not shown, a multiway valve may also be positioned between the filter 38 and the pump 40 to direct the wash liquor to the reclamation unit 14 for the further processing. After processing, the wash liquor may be returned to the re-circulation loop at an entry point anywhere along the loop. The re-circulation pump may be controlled to provide continuous operation, pulsed operation, or controlled operation. Returning to the embodiment of FIG. 1, re-circulation pump 40 then pumps the wash liquor to a multi-way re-circulation valve 42. Based on various programming, the re-circulation valve 42 may be defaulted to keep the wash liquor in the re-circulation loop or defaulted to route the wash liquor to another area, such as the reclamation unit 14. For example, re-circulation valve 42 may include a re-circulation outlet 44 and a reclamation outlet 46. In the embodiment where re-circulation is desired, wash liquor is shunted via the re-circulation outlet 44 to a dispenser 48.

As mentioned above concerning the sump 36, a heater (not shown) may also be associated with the dispenser to modulate the temperature of the dispenser contents. After mixing or heating, if any is to be done, the dispenser contents exit the dispenser via a dispenser outlet 50. Dispenser outlet 50 may be gated to control the outflow of the contents. In this regard, each chamber in the dispenser may be individually gated. The contents exit the dispenser via outlet 50 and enter a fill inlet 52, which is in fluid communication with the wash chamber 26. As shown in FIG. 1, the fill inlet 52 is generally located in the boot 28. The dispenser may be consumer accessible to refill the chambers if desired.

Fill inlet may also include one or more dispensing heads (not shown), such as nozzles or sprayers. The head may be adapted to repel wash liquor or a particular adjuvant so that clogging is avoided or minimized.

Figure 2:
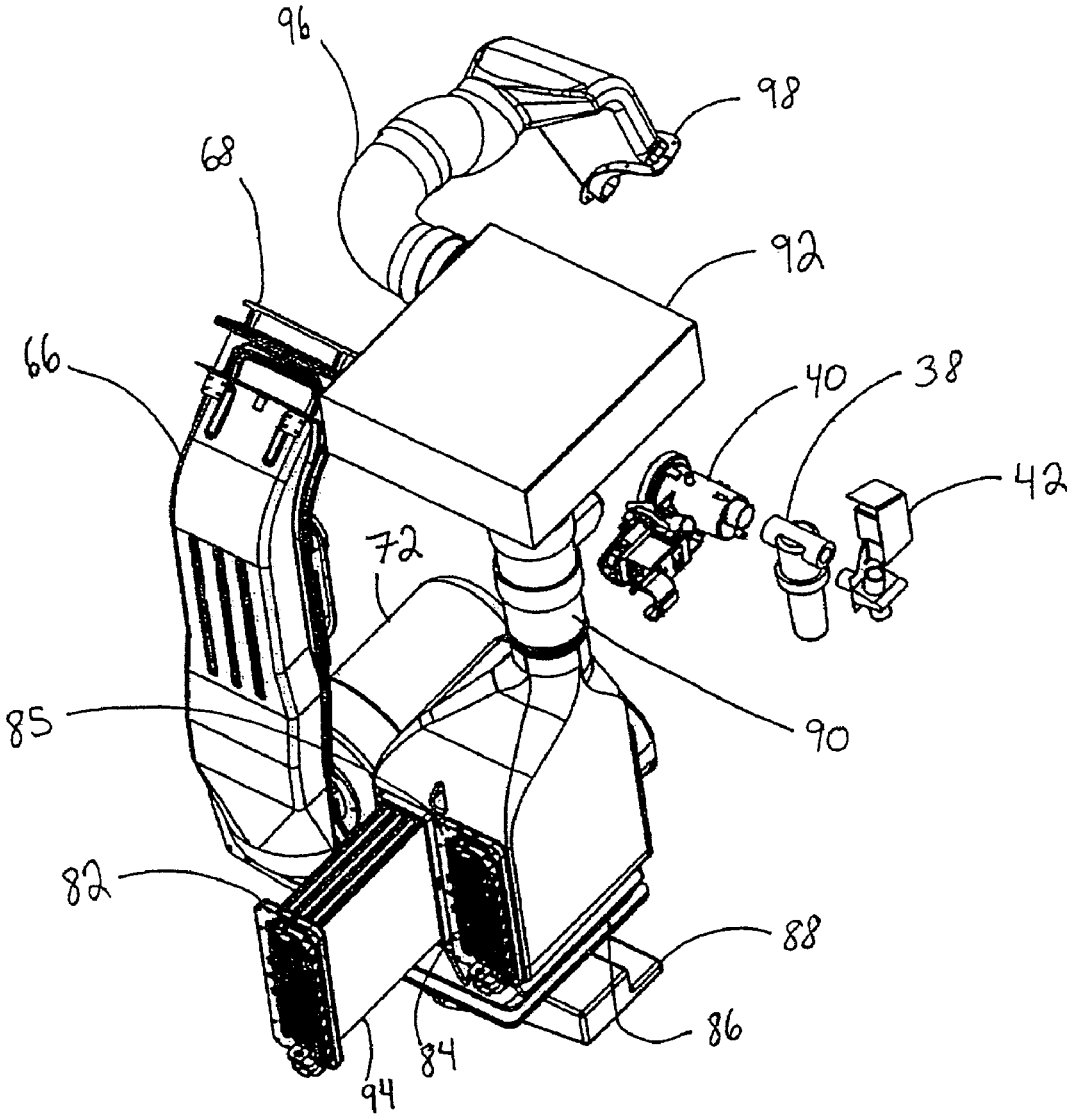
FIG. 2 depicts components for the drying cycle in the present invention.

FIG. 2 depicts a view of the drying loop. In one embodiment, air from the chamber 26 is to communicate with the flexible conduit in fluid communication with a lint filter housing 66, which contains a lint filter 68. Large particulates can be captured by the lint filter 68 to avoid the build-up of particulates on the components in the drying loop, such as the blower, the condenser, the heater, etc. The lint filter housing 66 may also include a filter lock that is adapted to lock down the lint filter 68 when the machine is activated to avoid a breach of the closed system. In addition, when the machine is deactivated, the consumer can clean the lint filter 68 as one normally would do in traditional drying machines. The lint filter 68 may also include a gasket at the interface of the lint filer 68 and the wash unit outer housing. While shown as one filter, there may be many lint filters in the air flow path to collect as much particulates as possible and these lint filters may be located anywhere along any path or loop or be incorporated into the condenser design. The lint filter housing 66 is in fluid communication with a blower 72. The use of multiple lint filters before the blower 72 would minimize the amount of particulates entering the remaining portion of the drying cycle.

FIG. 2 also shows a condenser system. FIG. 2 shows an illustrative view of the condenser units, in particular showing a first condenser unit 82 and a second condenser unit 84 inside the condenser body 85. FIG. 2 also shows a condenser pan 86 generally located at the bottom of the body 85. In this regard, air is blown from the blower 72 into the condenser system and is passed over the condenser units. In one embodiment, the air inflow may be passed over a diffuser to diffuse the air over the condenser units. In another embodiment, the body 85 is divided into two or more chambers by at least one septum. Accordingly, air is blown from the blower 72 into the system, passes into the body 85, and thereby passes over the first condenser unit 82. Condensation occurs and the condensate drips down into the pan 86. Meanwhile, the air is routed, optionally via a molded piece or a baffle, from the first chamber into a second one and over the second condenser unit 84. Condensation from the second condenser unit 82 drips down into the condenser pan 86. The condensate in the drip pan 86 is routed to a condenser sump 88. The condenser sump can be separate from or integral to the wash chamber sump (not shown). The air that passes the second condenser unit 84 is routed via a heater conduit 90 that ultimately connects to a heater 92. The condenser units 80 may be consumer accessible and may be adapted to be accessed once the machine 10 is deactivated. FIG. 2 shows a condenser unit 82 partially removed from the condenser body 85.

Although shown in FIG. 2 as a vertical condenser unit 82, 84, the condenser units may be angled relative to the airflow. In this regard, the individual plates 94 of the unit are in maximum contact with the airflow. In addition, as condensation forms on the plates, the condensation may form droplets that further increase the surface area in contact with the airflow. This stimulates further condensation. In addition, as the droplet size increases beyond the point where the droplet can remain static on the plate 94, it will drip down into the pan. The stream of liquid caused by the droplet movement also increases the surface area exposed to the airflow and thereby stimulates further condensation.

In addition, although shown in FIG. 2 as one wash chamber conduit 96, there may be several outlets from the heater into the same conduit 96. Furthermore, there may be one conduit 96 splitting into multiple wash chamber inlets 98. In effect, it may be desirable to have multiple inlets into the wash chamber so that hot airflow may be maximized and that excellent drying achieved.

Figure 3:
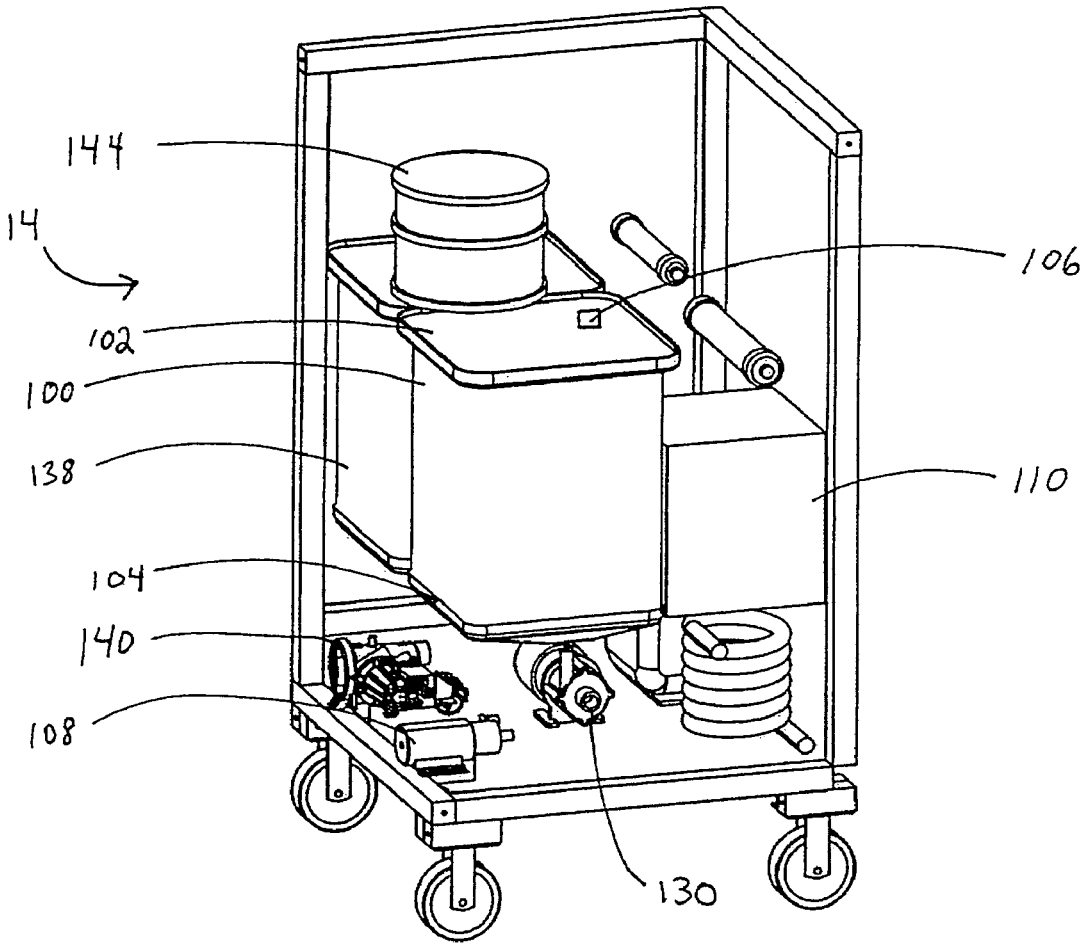
FIG. 3 depicts part of the recovery apparatus for the invention.

FIG. 3 demonstrates an embodiment of the reclamation unit 14 with the reclamation unit outer housing removed. Fluid returned from the wash unit 12 is preferably routed to an optional waste tank 100. In some instances the waste tank may be replaced with a select rinse fluid storage tank. The optional waste tank 100 includes a waste tank top surface 102, a waste tank bottom area 104, and a waste tank outlet (not shown). The waste tank 100 comprises a material compatible with the working fluid used. Additionally, the tanks should be compatible with the range of working fluids suggested in this specification that may be used in such an application. The tank is preferably clear or semi-opaque so that the fluid level of the tank can be readily determined. In addition, the tank may also include internal or external fluid level indicators, such as graduated markings. The tank volume may be greater than the sum total volume of working fluid plus any adjuvants used such that the entire fluid volume of the machine can be adequately stored in the waste tank. The waste tank bottom area 104 may be shaped as to direct the waste tank contents towards the waste tank outlet (not shown). In one embodiment, the waste tank outlet is generally located at the bottom of the waste tank so that gravity assists the fluid transport through the waste tank outlet. The waste tank may also include a pressure relief valve 106 to relieve accumulated pressures in the tank.

With regard to tank construction, if the tank is not uniformly molded, then any seals ought to be tight and resistant to wear, dissolution, leaching, etc. The inside walls of the tank can be microtextured to be very smooth, without substantial surface defects, so that waste fluid entering the tank is easily flowed to the tank bottom. In addition, the inside wall should be easily cleanable. To this end, the tank may include a series of scrapers that periodically scrape the sidewalls and bottom to ensure that little or no waste sticks to the walls and the bottom and that such waste is channeled to the tank outlet. The scrapers may be controlled via programming. Although not shown, the tank outlet may also include a removable particulate filter. Additionally, the tank may include a layer of insulation material that helps sustain the desired temperatures for each systems' heating/cooling mechanisms either within or surrounding the tanks.

The tank outlet is in fluid communication with a high pressure pump 108, which pumps the waste tank contents into a chiller 110, which further cools the waste tank contents. The chiller preferably resides in an insulated box to maintain a cooler environment.

Figure 4:
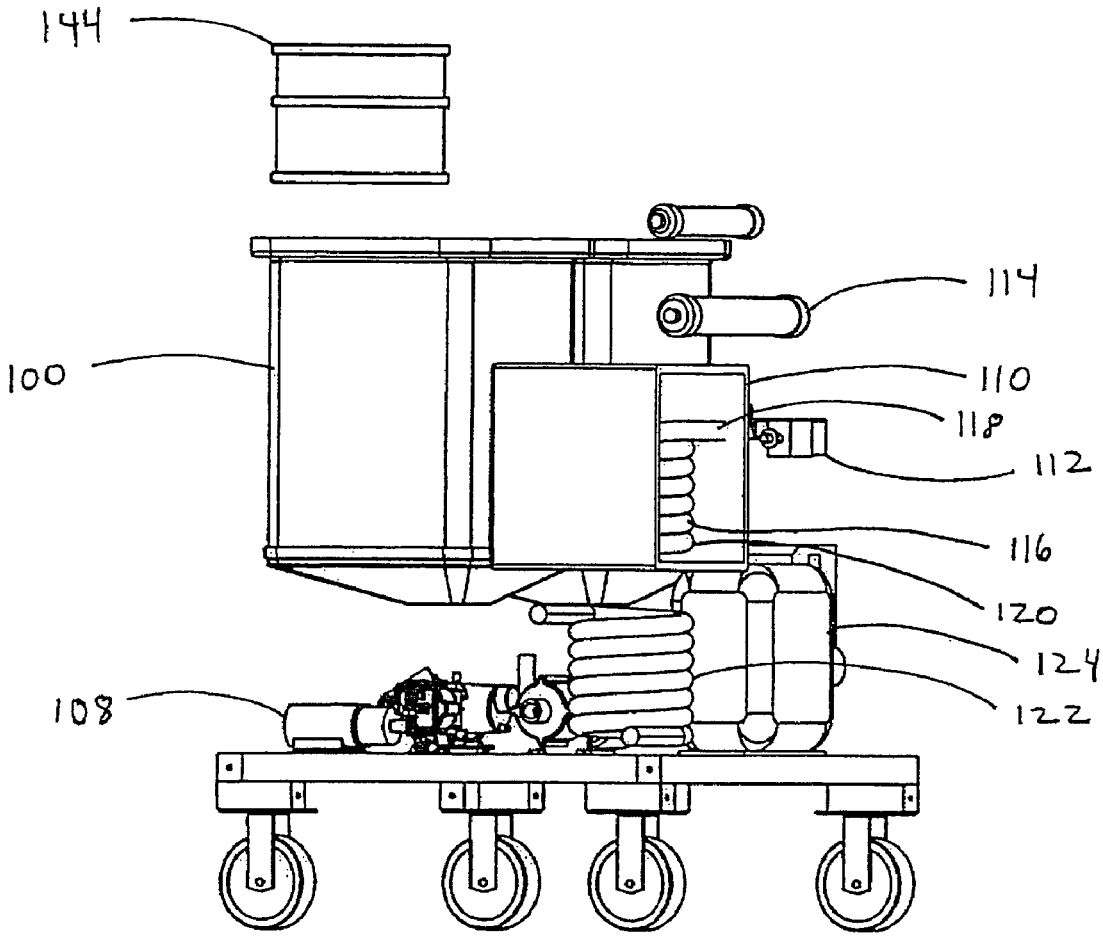
FIG. 4 depicts another view of the recovery apparatus.

FIG. 4 demonstrates a partial back end view of the reclamation unit. The cooled waste tank contents are then pumped from the chiller to a chiller multiway valve 112. Between the chiller and the multiway valve 112 is a temperature sensor (not shown). The default position of the valve shunts the cooled waste tank contents back into the waste tank 100. Thus, cooled waste tank contents are returned to the waste tank 100. The waste tank 100 may also include a temperature sensor to measure the temperature of the waste tank contents. When the desired temperature is achieved, for example, less than 0° C., the multiway valve 112 may shunt the cooled waste tank contents into a cross flow membrane 114. A less than zero temperature is desirable as water will freeze and thus not permeate in the cross flow membrane.

FIG. 4 also shows the chiller 110 with the back panel removed to show the chiller contents. The chiller 110 may comprise a chilling coil 116 that has a coil inlet (not shown) and a coil outlet 118. The chilling coil 116 may include an outer cover 120 such that the chilling coil 116 and the outer cover 120 form a coaxial arrangement. Disposed between the coil 116 and the outer cover 120 is a coolant. Accordingly, the coolant being carried by the outer cover 120 chills waste tank contents flowing through the coil 116. The coolant is circulated into the chiller 110 via a compressor system, which includes a coolant coil 122 and a coolant compressor 124. Thus, the compressor 124 cools the coolant in the coolant coil 122. This cooled coolant is then pumped into the coaxial space between the outer cover 120 and the chilling coil 116, such that the waste tank contents are ultimately cooled. This default loop continues for as long as necessary.

Figure 5:
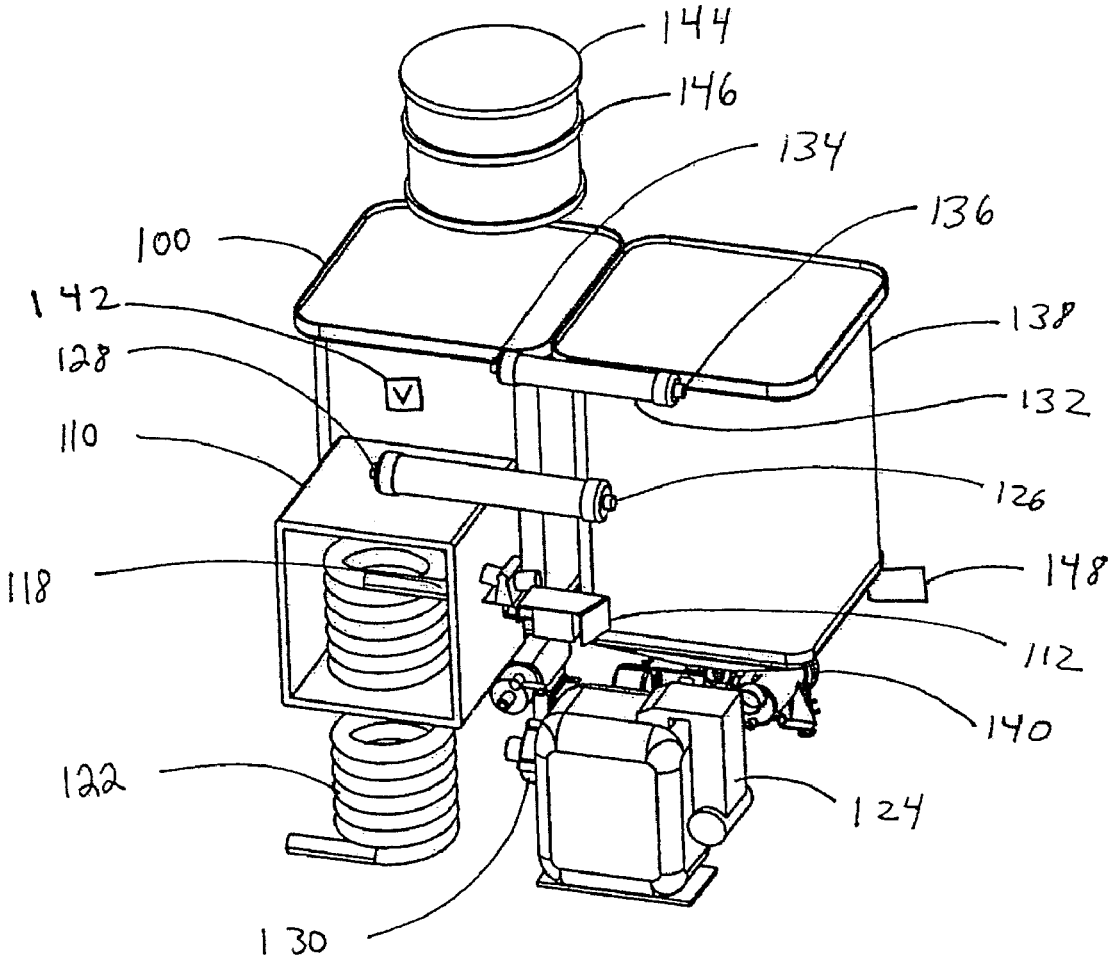
FIG. 5 depicts another view of the recovery apparatus.

It is also understood that other cooling technologies may be used to cool the waste tank contents as desired. For example, instead of having water cool the compressor system, an air-cooled heat exchanger similar to a radiator can be used. Alternatively, the working fluid may be cooled by moving water through cooling coils, or by thermoelectric devices heaters, expansion valves, cooling towers, or thermo-acoustic devices to, cool the waste tank contents FIGS. 4 and 5 demonstrate the waste tank content flow. As mentioned above, once the desired temperature is achieved, the multiway valve 112 shunts the flow to the cross flow membrane 114. In an alternate embodiment, a re-circulation loop may be set up such that the waste tank contents are re-circulated through the chiller 110, as opposed to being routed back into the waste tank 100. In this regard, the chiller multiway valve 112 may have an additional shunt that shunts the contents back into the path between the high-pressure pump 108 and the chiller 110. Once the desired temperature is achieved, the multiway valve 112 shunts the flow to the cross flow membrane 114. The cross flow membrane 114 has a proximal end 126 and a distal end 128. As waste tank contents are pumped into the proximal end 126, filtration begins and a permeate and a concentrate waste are formed.

The permeate flows down to the bottom of the cross flow membrane and exits the membrane 114 and enters a permeate pump 130. This permeate pump 130 pumps the permeate into a permeate filter 132, such as a carbon bed filter. The permeate enters the permeate filter 132 via the permeate filter proximal end 134, travels across the filter media, and exits via the permeate filter distal end 136. The permeate filter is selected for its ability to filter out organic residues, such as odors, fatty acids, dyes, petroleum based products, or the like that are miscible enough with the bulk solvent to pass through the cross flow membrane. Such filters may include activated carbon, alumina, silica gel, diatomaceous earth, aluminosilicates, polyamide resin, hydrogels, zeolites, polystyrene, polyethylene, divinyl benzene and/or molecular sieves. In any embodiment, the permeate may pass over or through several permeate filters, either sequentially or non-sequentially. In addition, the permeate filter may be one or more stacked layers of filter media. Accordingly, the flow may pass through one or more sequential filters and/or one or more stacked and/or unstacked filters. The preferred geometry for liquid and vapor removal for activated carbon is spherical and cylindrical. These systems may have a density between 0.25 to 0.75 g/cm$^3$ with preferred ranges of 0.40 to 0.70 g/cm$^3$. Surface areas may range from 50 to 2500 m$^2$/g with a preferred range of 250 to 1250 m$^2$/g. The particle size may range from 0.05 to 500 μm with a preferred range of 0.1 to 100 μm. A preferred pressure drop across the packed bed would range from 0.05 to $1.0\times10^6$ Pa with a preferred range of 0.1 to 1000 Pa. A porosity may range from 0.1 to 0.95 with a preferred range from 0.2 to 0.6.

After the permeate is filtered, the permeate is routed into the clean tank 138, where the permeate, which is now substantially purified working fluid, is stored. The purified working fluid should be greater than 90% free from contaminants with a preferred range of 95% to 99%. As desired, the working fluid is pumped from the clean tank 138 via a fill pump 140 to the wash unit 12.

The cross flow membrane 114 is also selected for its ability to filter out the working fluid as a permeate. Cross flow membranes may be polymer based or ceramic based. The membrane 114 is also selected for its ability to filter out particulates or other large molecular entities. The utility of a cross flow membrane, if polymer based, is a function of, inter alia, the number of hollow fibers in the unit, the channel height (e.g., the diameter of the fiber if cylindrical), length of the fiber, and the pore size of the fiber. Accordingly, it is desirable that the number of fibers is sufficient to generate enough flow through the membrane without significant back up or clogging at the proximal end. The channel height is selected for its ability to permit particulates to pass without significant back up or clogging at the proximal end. The pore size is selected to ensure that the working fluid passes out as permeate without significant other materials passing through as permeate. Accordingly, a preferred membrane would be one that would remove all particulate matter, separate micelles, separate water and other hydrophilic materials, separate hydrophobic materials that are outside the solubility region of the working fluid, and remove bacteria or other microbes. Nano-filtration is a preferred method to remove bacteria and viruses.

Ceramic membranes offer high permeate fluxes, resistance to most solvents, and are relatively rigid structures, which permits easier cleaning. Polymer based membranes offer cost effectiveness, disposability, and relatively easier cleaning. Polymer based membranes may comprise polysulfone, polyethersulfone, and/or methyl esters, or any mixture thereof. Pore sizes for membranes may range from 0.005 to 1.0 micron, with a preferred range of 0.01 to 0.2 microns. Flux ranges for membranes may range from 0.5 to 250 kg/hour of working fluid with a preferred minimum flux of 30 kg/hour (or about 10-5000 kg/$m^2$). Fiber lumen size or channel height may range from 0.05 to 0.5 mm so that particulates may pass through. The dimension of the machine determines the membrane length. For example, the membrane may be long enough that it fits across a diagonal. A length may, preferably, be between 5 to 75 cm, and more preferably 10 to 30 cm. The membrane surface area may be between 10 to 2000 $cm^2$, with 250 to 1500 $cm^2$ and 300 to 750 $cm^2$ being preferred.

The preferred membrane fiber size is dependent upon the molecular weight cutoff for the items that need to be separated. As mentioned earlier, the preferred fiber would be one that would remove all particulate matter, separate micelles, separate water and other hydrophilic materials, separate hydrophobic materials that are outside the solubility region of the working fluid, and remove bacteria or other microbes. The hydrophobic materials are primarily body soils that are mixtures of fatty acids. Some of the smaller chain fatty acids ($C_{12}$ and $C_{13}$) have lower molecular weights (200 or below) while some fatty acids exceed 500 for a molecular weight. A preferred surfactant for these systems are silicone surfactants having an average molecular size from 500-20000.

For example, in siloxane based working fluid machines, the fiber should be able to pass molecular weights less than 1000, more preferably less than 500 and most preferably less than 400. In addition, the preferred fibers should be hydrophobic in nature, or have a hydrophobic coating to repel water trying to pass. For the contaminants that pass through the fibers, the absorber and/or absorber filters will remove the remaining contaminants. Some preferred hydrophobic coatings are aluminum oxides, silicone nitrate, silicone carbide and zirconium. Accordingly, an embodiment of the invention resides in a cross flow membrane that is adapted to permit a recovery of the working fluid as a permeate.

Returning to FIGS. 4 and 5, the permeate took the path that led to a permeate pump. The concentrate, however, takes another path. The concentrate exits the cross flow membrane distal end 128 and is routed to a concentrate multiway valve 142. In the default position, the concentrate multiway valve 142 shunts the concentrate to the waste tank 100. The concentrate that enters the waste tank 100 is then routed back through the reclamation process described above. Once the concentrate multiway valve is activated, the concentrate is routed to a dead end filter 144.

The dead end filter 144 may be a container that includes an internal filter 146. As concentrate enters the dead end filter 144, the concentrate collects on the internal filter 146. Based on the type of filter used, permeate will pass through the filter 146 and be routed to the waste tank 100 or eventually into the clean tank. The concentrate will remain in the dead end filter. To assist in drawing out remaining liquids from the concentrate so that it passes to the waste tank, a vacuum may be created inside to draw out more liquid. In addition, the dead end filter 144 may include a press that presses down on the concentrate to compact the concentrate and to squeeze liquids through the internal filter 146. The dead end filter 144 may also include one or more choppers or scrapers to scrape down the sides of the filter and to chop up the compacted debris. In this regard, in the next operation of the press, the press recompacts the chopped up debris to further draw out the liquids. The dead end filter may be consumer accessible so that the dead end filter may be cleaned, replaced, or the like; and the remaining debris removed. In addition, the dead end filter may be completed without the assistance of a vacuum, in a low temperature evaporation step or an incineration step. Capturing the concentrate/retentate and then passing a low heat stream of air with similar conditions to the drying air over the filter will complete the low temperature evaporation step. The working fluid will be removed and then routed to the condenser where it will condense and then return to the clean tank.

Another concern that needs to be addressed is the re-use of the filters beds. Some potential means to prevent fouling or to reduce fouling are via chemical addition or cleaning, reducing the temperature and phase changing the water to ice and then catching the ice crystals via a filter mechanism, or coating the membranes with special surfaces to minimize the risk of fouling. A way to regenerate the filters includes but is not limited to the addition of heat, pH, ionic strength, vacuum, mechanical force, electric field and combinations thereof.

FIGS. 6-10 illustrate various methods of washing and drying fabrics in accordance with the present invention. In FIGS. 6-10, a first step in practicing the present invention is the loading of the machine 200 or chamber. The next step involves the addition of the wash liquor 202. The wash liquor is preferably a combination of a working fluid and optionally at least one washing additive. The working fluid is preferably non-aqueous, has a surface tension less than 35 dynes/cm and has a flash point of at least 140° F. or greater as classified by the National Fire Protection Association. More specifically the working fluid is selected from terpenes, halohydrocarbons, glycol ethers, polyols, ethers, esters of glycol ethers, esters of fatty acids and other long chain carboxylic acids, fatty alcohols and other long chain alcohols, short-chain alcohols, polar aprotic solvents, siloxanes, hydrofluoroethers, dibasic esters, aliphatic hydrocarbons and/or combinations thereof. Even more preferably, the working fluid is further selected from decamethylcyclopentasiloxane, dodecamethylpentasiloxane, octamethylcyclotetrasiloxane, decamethyltetrasiloxane, dipropylene glycol n-butyl ether (DPnB), dipropylene glycol n-propyl ether (DPnP), dipropylene glycol tertiary-butyl ether (DPtB), propylene glycol n-butyl ether (PnB), propylene glycol n-propyl ether (PnP), tripropylene methyl ether (TPM) and/or combinations thereof. The washing additive can be selected from the group consisting of: builders, surfactants, enzymes, bleach activators, bleach catalysts, bleach boosters, bleaches, alkalinity sources, antibacterial agents, colorants, perfumes, pro-perfumes, finishing aids, lime soap dispersants, composition malodor control agents, odor neutralizers, polymeric dye transfer inhibiting agents, crystal growth inhibitors, photobleaches, heavy metal ion sequestrants, anti-tarnishing agents, anti-microbial agents, anti-oxidants, linkers, anti-redeposition agents, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, fabric softening agents, optical brighteners, hydrotropes, suds or foam suppressors, suds or foam boosters, fabric softeners, antistatic agents, dye fixatives, dye abrasion inhibitors, anti-crocking agents, wrinkle reduction agents, wrinkle resistance agents, soil release polymers, soil repellency agents, sunscreen agents, anti-fade agents and mixtures thereof. The chamber 26 (as shown in FIG. 1) by its rotation adds mechanical energy 204 to the combination of the working fluid and fabric. The mechanical energy may be of the form of tumbling, agitating, impelling, nutating, counter-rotating the drum or liquid jets that spray fluids thus moving the fabrics. The mechanical energy should be added for a time ranging from 2-20 minutes. The wash liquor is then removed in step 206. Potential methods for removing the wash liquor include but are not limited to centrifugation, liquid extraction, the application of a vacuum, the application of forced heated air, the application of pressurized air, simply allowing gravity to draw the wash liquor away from the fabric, the application of moisture absorbing materials or mixtures thereof. In traditional aqueous machines, the extraction cycle is generally less than 10 minutes total. This time includes 1-3 minutes for the drain and at least 7 minutes for the spinning cycle. The non-aqueous cycle should be similar to the traditional system. In step 208, less than 20 liters per kilogram of cloth of the select rinse fluid is added to the chamber. The select rinse fluid (PRF) is selected based on being miscible with the working fluid and having Hanson solubility parameters (expressed in joules per cubic centimeter) with one of the following criteria: a polarity greater than about 3 and hydrogen bonding less than 9; hydrogen bonding less than 13 and dispersion from about 14 to about 17; or hydrogen bonding from about 13 to about 19 and dispersion from about 14 to about 22. More specifically the PRF will be selected for having the following properties: have a viscosity less than the viscosity of the working fluid, a vapor pressure greater than 5 mm Hg at standard conditions, surface tension less than the surface tension of the working fluid or be non-flammable. Even more specifically, the PRF is selected from the group consisting of perfluorinated hydrocarbons, decafluoropentane, hydrofluoroethers, methoxynonafluorobutane, ethoxynonafluorobutane and/or mixtures thereof. Next, mechanical energy is added to the system for a time from 2-20 minutes to combine the PRF, the remaining wash liquor and the fabric 210. This mechanical energy can be added continuously or intermittently throughout the cycle. Optionally, fabric enhancement agents can be added at step 214 in combination with the PRF or after the PRF has been removed. Some potential fabric enhancement agents include but are not limited to: fabric softeners, viscosity thinning agents such as cationic surfactants, soil repellency agents, fabric stiffening agents, surface tension reducing agents and anti-static agents. The remaining wash liquor and PRF are removed in step 212. A drying gas is introduced in step 216 and the solvent removed from the fabric is routed through a condenser 82 as shown in FIG. 2 and stored for reuse in 218. Preferably, but not limited to, the PRF should be recovered in step 222 and potentially re-used in the same or future process steps. After recovering the PRF, step 224 involves recovering the wash liquor and finally step 226 disposal of the contaminants. Finally, dry fabric 220 can be removed from the chamber at the end of the method. The preferred recovery techniques will be defined later in this specification.

Figure 6:
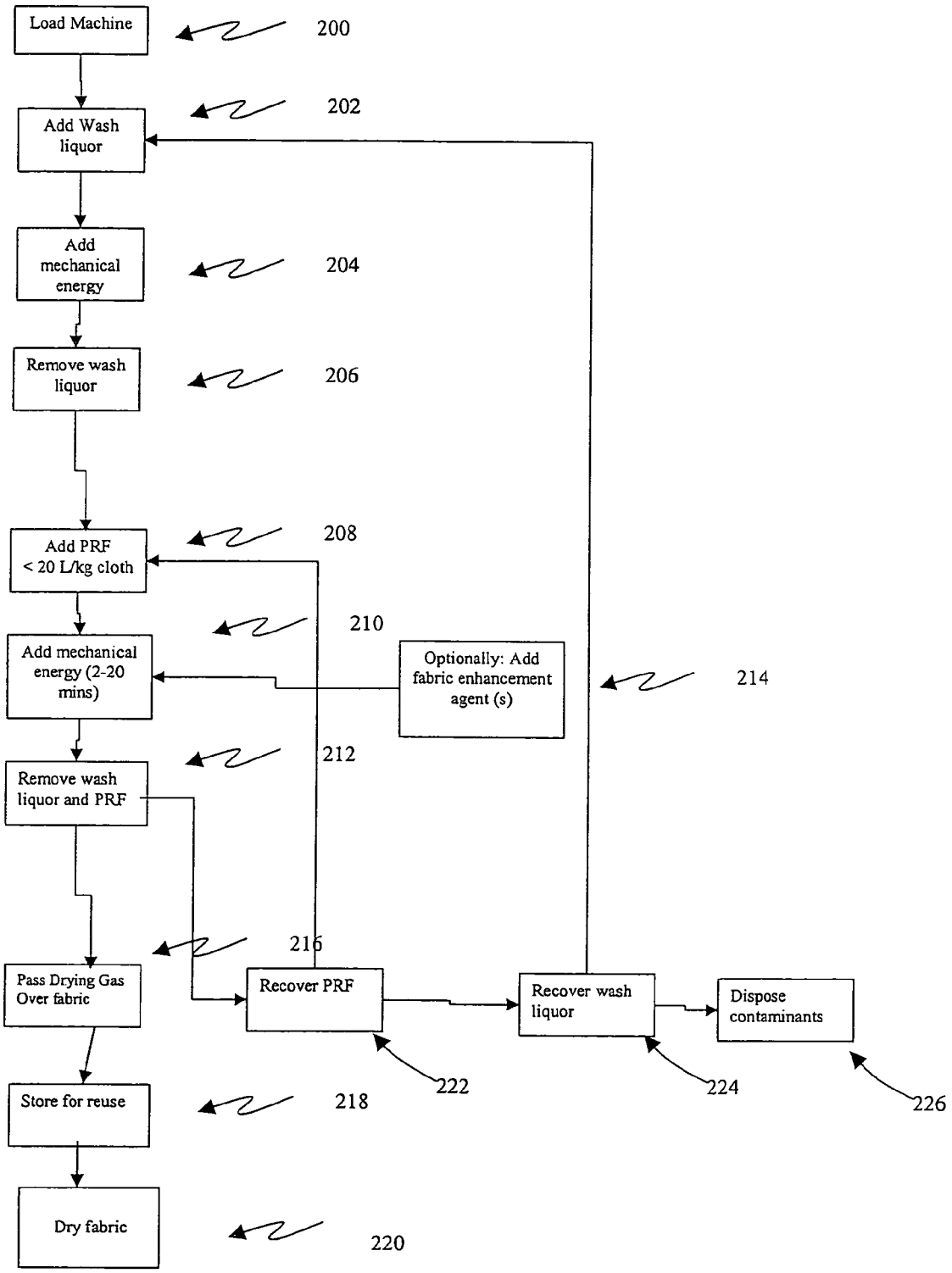
FIG. 6 is a flow diagram of one embodiment of wash and recovery events that with materials described make possible a self-contained non-aqueous laundering machine.
Figure 7:
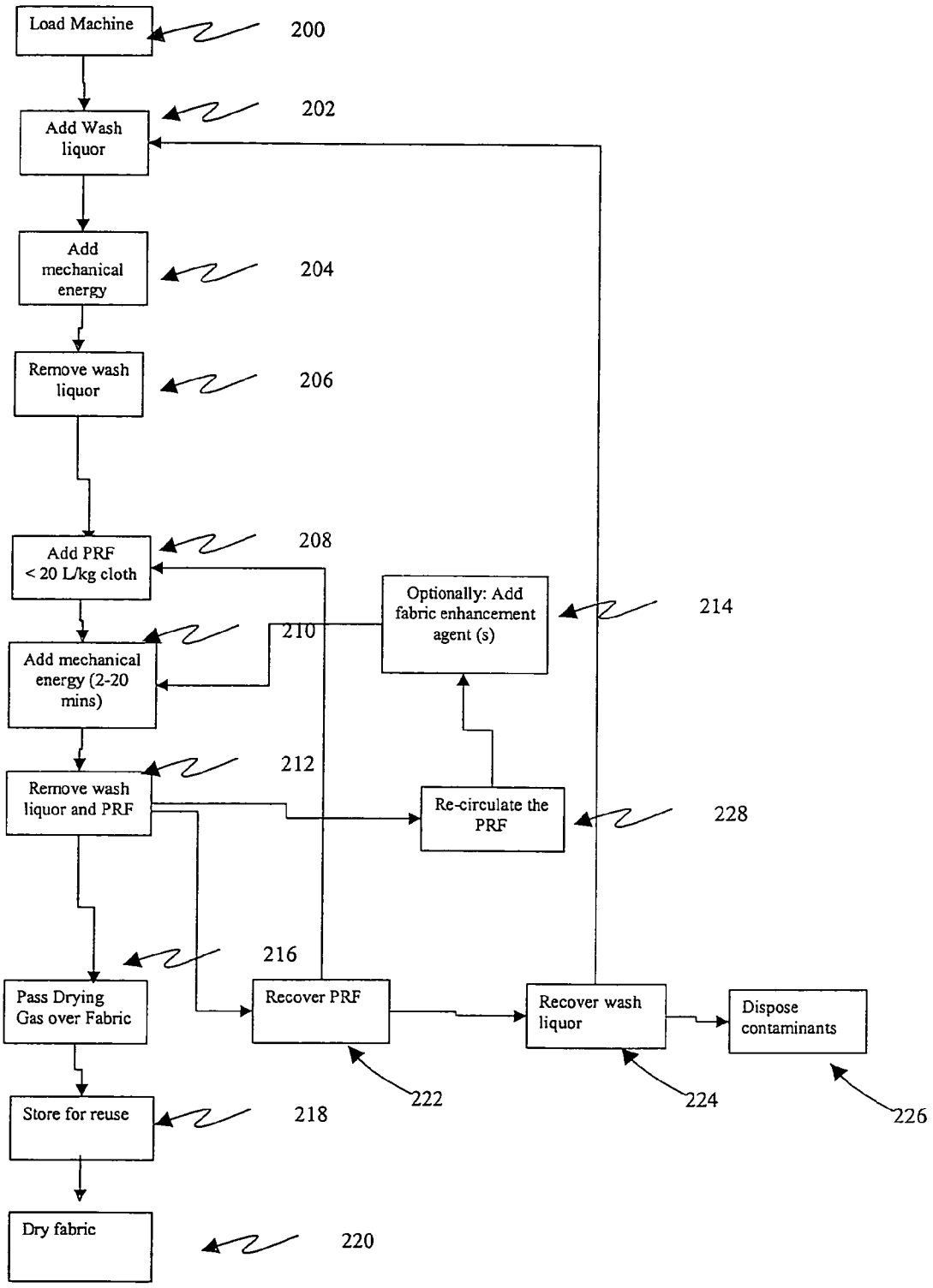
FIG. 7 is a flow diagram of a second embodiment of washing and recovery events that will with materials described make possible a self-contained non-aqueous laundering machine.

FIG. 7 depicts a method similar to FIG. 6 except for that it utilizes an additional step that decreases the amount of PRF that is needed. In this particular embodiment, the PRF is re-circulated in step 228 and introduced back into the wash chamber 26 while the mechanical energy is being added during step 208.

Figure 8:
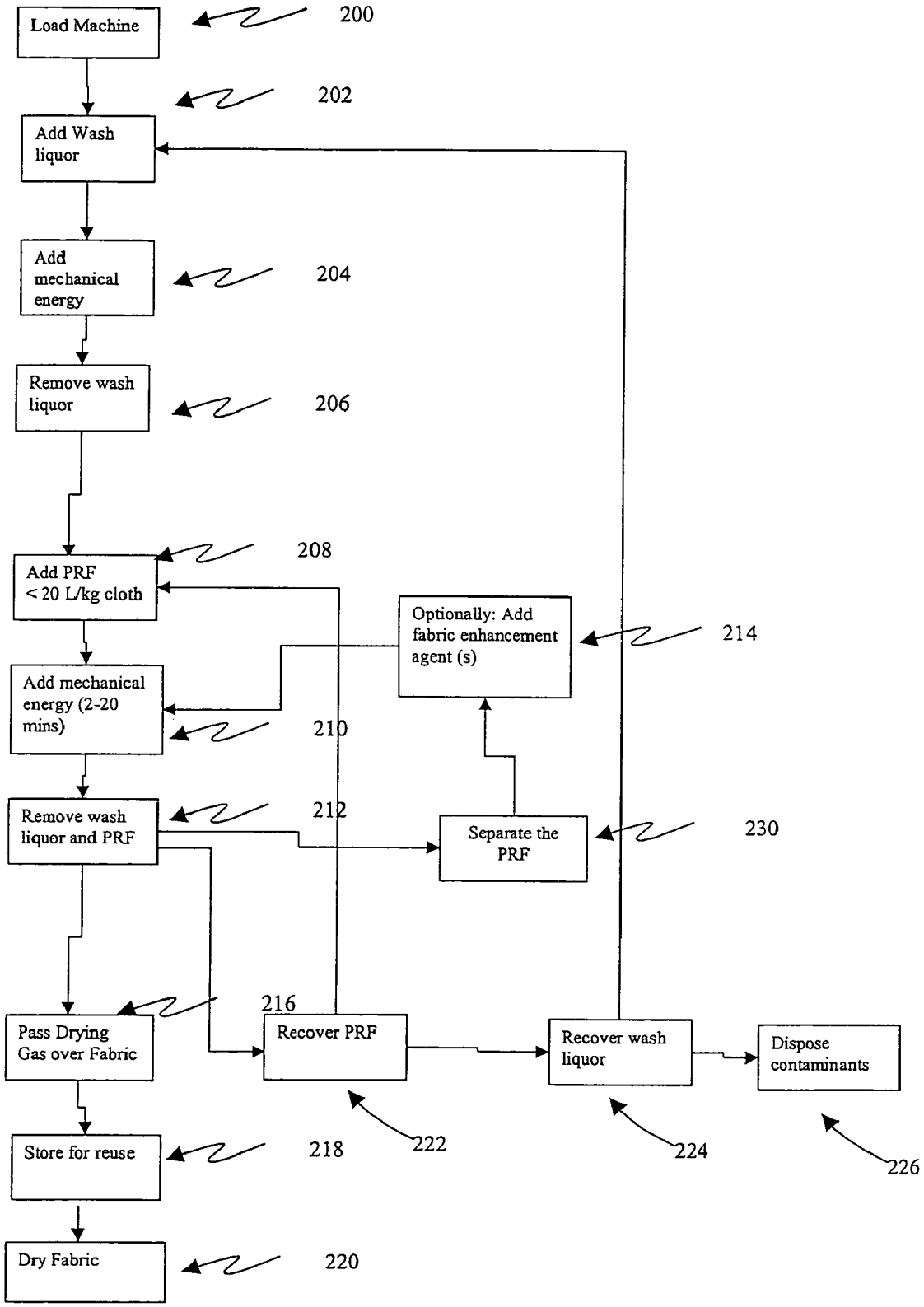
FIG. 8 is a flow diagram of another embodiment of washing and recovery events that with materials described make possible a self-contained non-aqueous laundering machine.

A dynamic rinse process is depicted in FIG. 8, where upon removal of the wash liquor and PRF in step 212, the PRF is separated from the wash liquor and re-circulated to the chamber in step 230. There are a variety of separation steps that may be useful including but not limited to: filtration, gravimetric separation, temperature reduction, adsorption, absorption, distillation, flotation, evaporation, third component extraction, osmosis, high performance liquid chromatography and/or a combination thereof.

Figure 9:
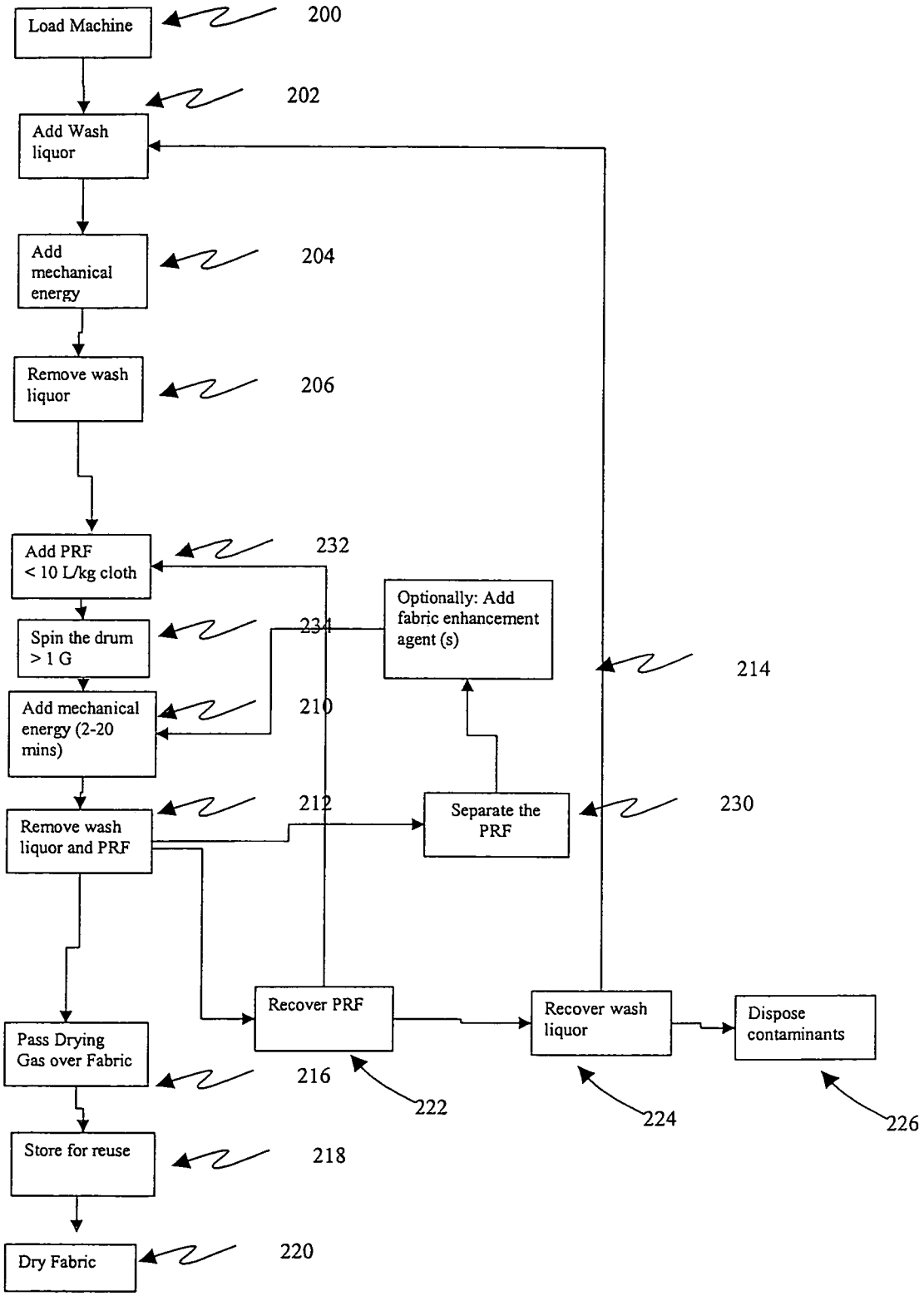
FIG. 9 is a flow diagram of an embodiment of washing and recovery events with materials described makes possible another embodiment of self-contained non-aqueous laundering machine.

FIG. 9 depicts a preferred embodiment wherein the amount of PRF used is minimized. In this method, after the wash liquor is removed from the fabric in step 206, less than 10 liters of PRF per kilogram of cloth is added in step 232. The drum is spinning at a centrifugal force of greater than at least 1 G in step 234. The drum should be spinning at such a velocity to promote the fabric moving toward the surface of the perforated drum.

Figure 10:
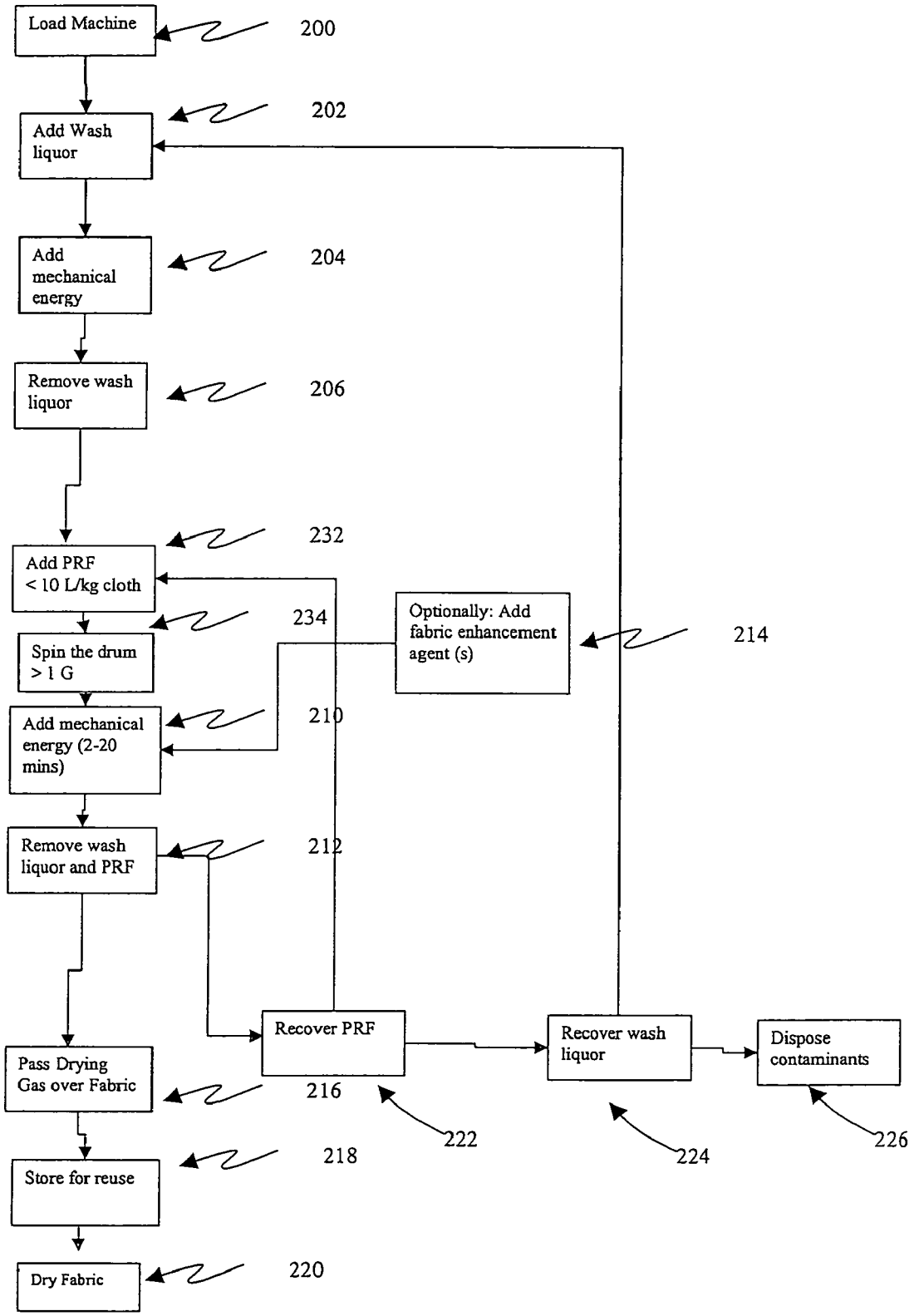
FIG. 10 is a flow diagram of another embodiment of washing and recovery events that with materials described make possible another embodiment of a self-contained non-aqueous laundering machine.

In the process depicted in FIG. 10, the spray rinsing technology utilizes the addition of the PRF without the added benefit of re-circulating the fluid. In both the spray rinse methods, depicted in FIGS. 9 and 10, the wash liquor is further removed by passing the fluid through the fabric and this benefit is further increased through the use of extracting the fluid with a centrifugal force sufficient to move the fabrics toward the surface of the drum.

The processes depicted in FIGS. 9 and 10, the preferred apparatus should include a dispensing device that allows the PRF to be distributed along the entire depth of the fabrics. This is preferably accomplished by spraying the PRF onto the fabrics while they are against the surface of the drum.

In FIGS. 6-10, step 210 should be continued for a time which ensures that the wash liquor concentration remaining on the fabric (as defined by kilogram of working fluid per kilogram of cloth) falls to at least 45%, more preferably below 25% and most preferably below 15%.

Figure 11:
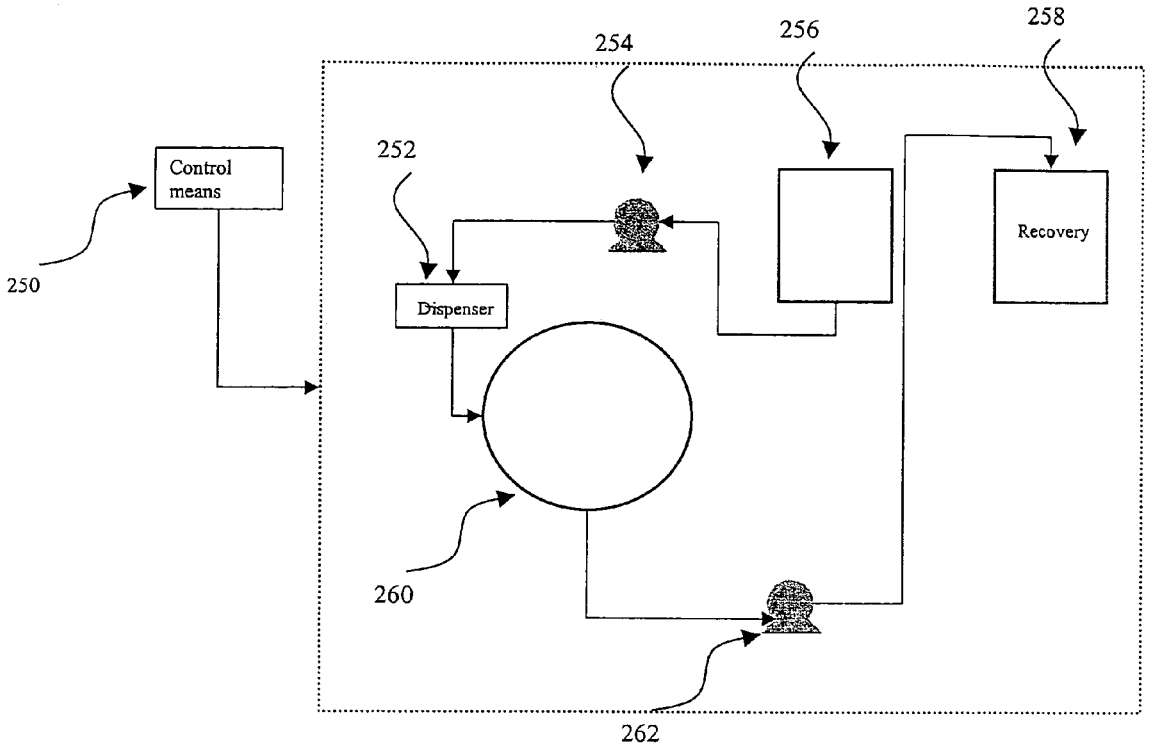
FIG. 11 is an apparatus wherein one of the above methods for washing and drying can be completed. This apparatus describes the components that are critical for the select rinse fluid step.

FIG. 11 depicts an apparatus wherein the above methods are accomplished. In FIG. 11, a control means 250 regulates the time in which each step occurs, the tumbling pattern of the drum, the physical parameters are sensed, the methods are selected, etc. A drum 260 is actuated by a motor that provides the mechanical energy in the above methods. A pump 262 removes working fluid, wash liquor and PRF from the system and sends the material to the recovery unit 258. The pump may be a positive displacement type, a kinetic or open screw type mechanical pump. Pumping is not limited to mechanical means and other types of pumps that be utilized such as piezo-electric, electrohydrodynamic, thermal bubble, magnetohydrodynamic and electroosmotic. The PRF and working fluid are stored separately in the storage system 256 and are delivered to the drum through the use of the delivery pump 254. The pump passes the working fluid and/or PRF through the dispensing system 252 where either the washing additive and/or fabric enhancement agents can be added to the system.

In some instances the working fluid and the PRF are immiscible and the miscibility gap could be overcome by a change in temperature or the addition of one or more components. In some instances, it is preferred that the molecular weight of the PRF should be less than the molecular weight of the working fluid.

In any of the aforementioned figures, heating may be supplied at any time to heat the machine, one or more machine components, the fluids, the fabric, air or a combination thereof.

Additionally, apparatuses designed for the PRF should have condensing systems designed to handle multiple fluids. A preferred condensing system will preferentially separate the fluids according to boiling point and vapor pressure. Examples of such condensing systems have been taught in U.S. 20040117919. An example dealing with a PRF would have the PRF condensing, followed by the added water to the system, then a working fluid such as decamethylcyclopentasiloxane or dipropylene glycol n-butyl ether.

FIGS. 6-10 depict a system having only one rinse (the PRF rinse). In some embodiments, the system can optionally go through one or multiple rinses in cases where the working fluid is added to remove soil and the washing additives. Optionally, heat and air can be added separately or together to improve the extraction efficiency. Additionally, one or multiple rinses with the PRF may be used. The second PRF rinse could be used to dispense/deliver the fabric enhancement agents to the fabric.

Figure 12:
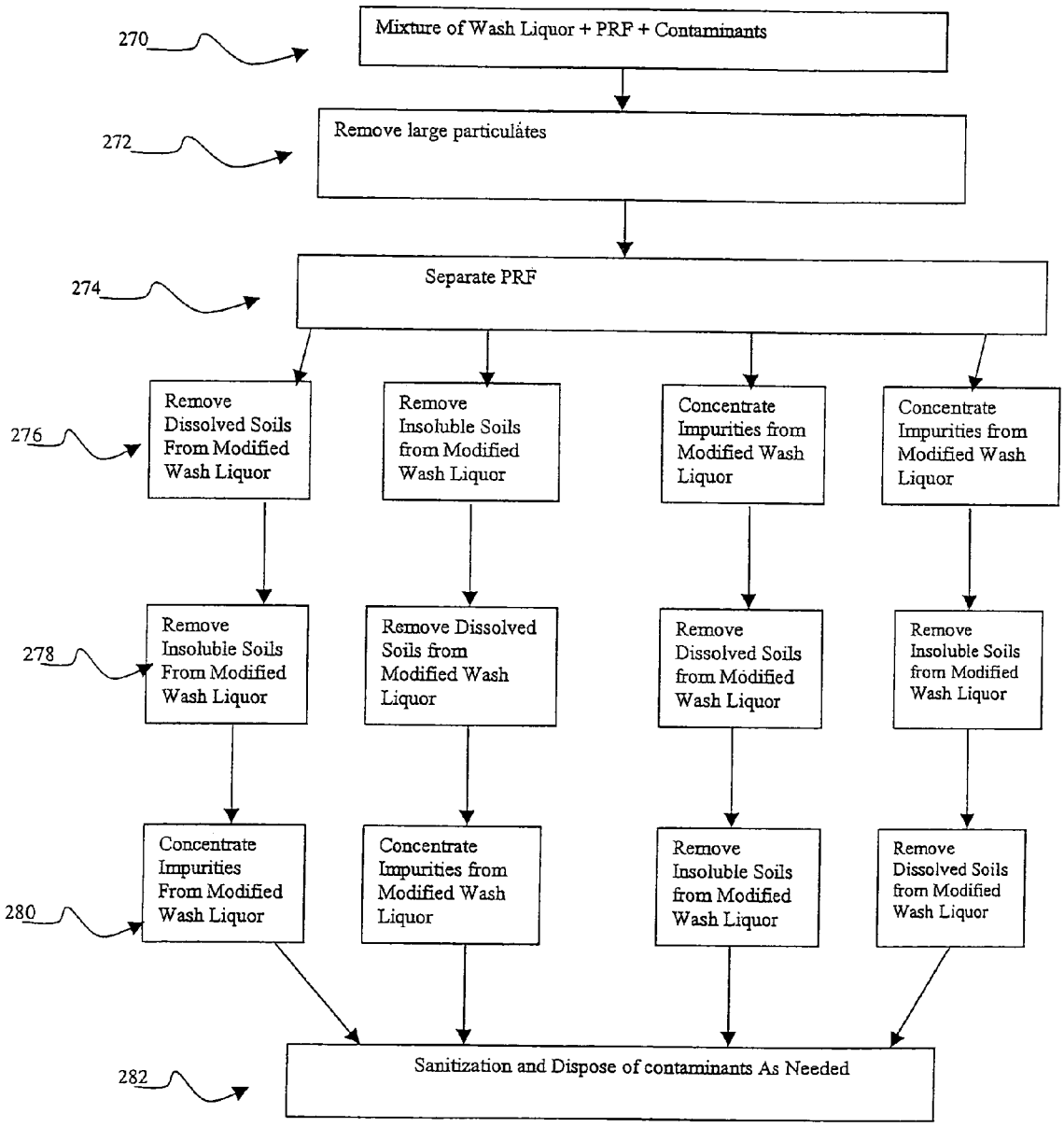
FIG. 12 represents potential recovery methods for a system containing a Select rinse Fluid.

FIG. 12 depicts shows other embodiments of the invention generally related to recovery. Although not shown, any loop or path may be repeated. In addition, it should be recognized that any step might be combined with another step or omitted entirely. The mixture of wash liquor, select rinse fluid and contaminants are introduced to the recovery system in step 270. FIG. 12 depicts an embodiments wherein one of the initial steps in the recovery process is to remove large particulates 272. As mentioned herein, any mode of large particulate removal is contemplated, including using the coarse lint filter, filtration, and other separation techniques. Large particulates can be buttons, lint, paper clips, etc., such as those having a size of greater than 50 microns. Small particulates may be less than 50 microns. A method of particulate removal may include a dehydration step in the wash chamber by heating the fabrics so that any residual water is removed. By doing so, the electrostatic bond between the dirt and fabric is broken, thereby liberating the dirt. This dirt can then be recovered. Other methods of particulate removal include but are not limited to vortex separation, flotation, solidification, centrifugation, electrostatic (phoresis), ultrasonic, gas bubbling, high performance liquid chromatography and chemical digestion.

The PRF is separated and recovered in step 274. Methods for separating the PRF from the wash liquor include, but are not limited to: fractional distillation, temperature reduction, addition of a flocculating agent, adsorption/absorption, liquid extraction through the use of another additive, filtration, gravimetric separation, osmosis, evaporation, chemisorption or a combination of the aforementioned steps. The final PRF that is recovered and stored for reuse should contain less than 50% by weight of working fluid, more preferably less than 25% and most preferably less than 10%. The PRF and working fluid mixture need not be separated until the concentration of the working fluid exceeds 25% by weight.

Dissolved soils include those items that are dissolved in the working fluid, such as oils, surfactants, detergents, etc. Mechanical and chemical methods or both may remove dissolved soils 276. Mechanical removal includes the use of filters or membranes, such as nano-filtration, ultra-filtration and microfiltration, and/or cross flow membranes. Pervaporation may also be used. Pervaporation is a process in which a liquid stream containing two or more components is placed in contact with one side of a non-porous polymeric membrane while a vacuum or gas purge is applied to the other side. The components in the liquid stream sorb into the membrane, permeate through the membrane, and evaporate into the vapor phase (hence the word pervaporate). The vapor, referred to as "the permeate", is then condensed. Due to different species in the feed mixture having different affinities for the membrane and different diffusion rates through the membrane, a component at low concentration in the feed can be highly enriched in the permeate. Further, the permeate composition may differ widely from that of the vapor evolved in a free vapor-liquid equilibrium process. Concentration factors range from the single digits to over 1,000, depending on the compounds, the membrane and process conditions.

Chemical separation may include change of state methods, such as temperature reduction (e.g., freeze distillation), temperature increase, pressure increase, flocculation, pH changes and ion exchange resins.

Other removal methods include electric coalescence, absorption, adsorption, endothermic reactions, temperature stratification, third component addition, dielectrophoresis, high performance liquid chromatography, ultrasonic and thermo-acoustic cooling techniques.

Insoluble soils 278 may include water, enzymes, hydrophilic soils, salts, etc. Items may be initially insoluble but may become soluble (or vice versa) during the wash and reclamation processes. For example, adding dissolvers, emulsifiers, soaps, pH shifters, flocculants, etc., may change the characteristic of the item. Other methods of insoluble soil removal include filtration, caking/drying, gravimetric, vortex separation, distillation, freeze distillation and the like.

The step of concentrating impurities 280 may include any of the above steps done that are done to reduce, and thereby purify, the working fluid recovery. Concentrating impurities may involve the use of multiple separation techniques or separation additives to assist in reclamation. It may also involve the use of a specific separation technique that cannot be done until other components are removed.

In some instances, the surfactants may need to be recovered. A potential means for recovering surfactants is through any of the above-mentioned separation techniques and the use of $CO_2$ and pressure.

As used herein, the sanitization step 282 will include the generic principle of attempting to keep the unit relatively clean, sanitary, disinfected, and/or sterile from infectious, pathogenic, pyrogenic, etc. substances. Potentially harmful substances may reside in the unit due to a prior introduction from the fabrics cleaned, or from any other new substance inadvertently added. Because of the desire to retrieve clean clothes from the unit after the cycles are over, the amount of contamination remaining in the clothes ought to be minimized. Accordingly, sanitization may occur due to features inherent in the unit, process steps, or sanitizing agents added. General sanitization techniques include: the addition of glutaraldehyde tanning, formaldehyde tanning at acidic pH, propylene oxide or ethylene oxide treatment, gas plasma sterilization, gamma radiation, electron beam, ultraviolet radiation, peracetic acid sterilization, thermal (heat or cold), chemical (antibiotics, microcides, cations, etc.), and mechanical (acoustic energy, structural disruption, filtration, etc.).

Sanitization can also be achieved by constructing conduits, tanks, pumps, or the like with materials that confer sanitization. For example, these components may be constructed and coated with various chemicals, such as antibiotics, microcides, biocides, enzymes, detergents, oxidizing agents, etc. Coating technology is readily available from catheter medical device coating technology. As such, as fluids are moving through the component, the fluids are in contact with the inner surfaces of the component and the coatings and thereby achieves contact based sanitization. For tanks, the inner surfaces of tanks may be provided with the same types of coatings thereby providing longer exposure of the coating to the fluid because of the extended storage times. Any coating may also permit elution of a sanitizer into the fluid stream. Drug eluting stent technology may be adapted to permit elution of a sanitizer, e.g., elution via a parylene coating.

Figure 13:
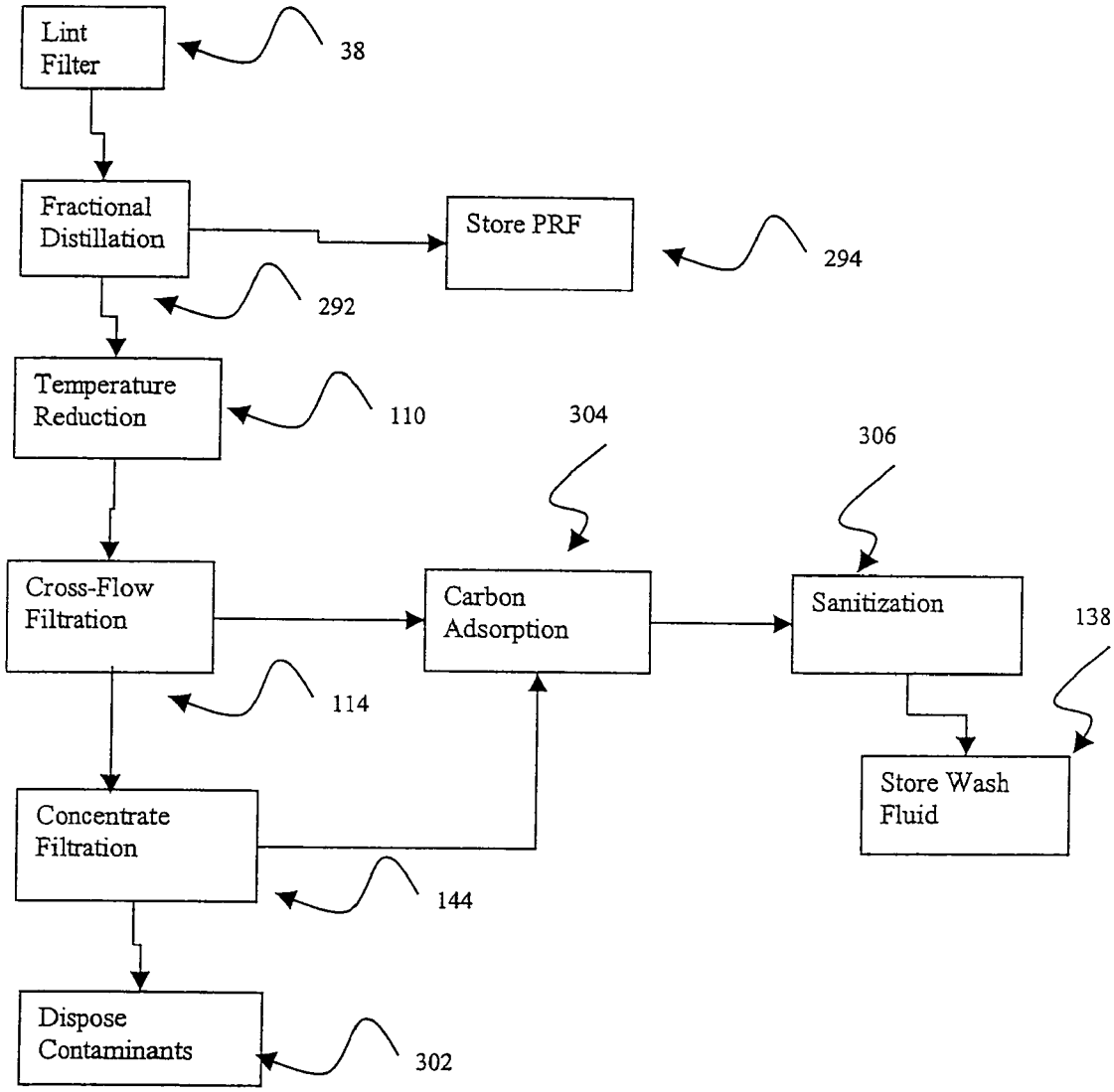
FIG. 13 represents the preferred recovery scheme for such an operation.

FIG. 13 represents the preferred recovery method for a select rinse fluid system. A lint filter 38 will remove large particulates as well as lint prior to introduction into the distillation unit. A fractional distillation unit 292 will separate the PRF from the remaining wash liquor. The PRF will be collected and stored for reuse in 294. The wash liquor and contaminants remaining from the distillation unit will undergo a temperature reduction step 110 as described above. Some dissolved contaminants will come out of solution and the entire mixture will pass through a cross flow filter 114. The cross flow filter will concentrate the remaining contaminants in a small amount of working fluid and this stream will pass a concentrate filter 144 and the contaminants collected can the be disposed 302. The permeate stream from the cross flow filtration operation will pass through a carbon adsorption bed 304 and through a sanitization technique in 306 and be stored for reuse 138.

As was mentioned earlier, modifications of the machine shown in U.S. patent application Ser. No. 10/699,262, "Non-Aqueous Washing Apparatus", filed Oct. 31, 2003, has been used to test the efficacy of the washing and recovery operations depicted in the drawings. Experiments have been conducted to show the power of the operation and details of such an application.

In one experiment, decamethylcyclopentasiloxane was used as the wash liquor and a commercially available detergent package was used with a 3-kg load of cotton stuffers. The load was washed in the decamethylcyclopentasiloxane/detergent wash liquor for 10 minutes followed by an extraction at 1150 rpm for 7 minutes. The average retention (kg solvent remaining/kg cloth) was 25%. Ethoxynonafluorobutane, HFE-7200, was added to the system and re-circulated for 4 minutes. Another extraction at 1150 rpm at 7 minutes was completed and the fabrics were dried with a low temperature air stream at 60° C. and 150 $ft^3$/min. The retention and drying time were recorded for each sample. Table 1 summarizes the result.

TABLE 1

| Load Size (kg) | LCR (Liters HFE/kg cloth) | Retention % | Dry Time (min) |
|---|---|---|---|
| 3.0 | 1.0 | 14.3 | 20 |
| 3.0 | 2.0 | 11.7 | 20 |
| 3.0 | 3.0 | 8.9 | 10 |

As can be seen in Table 1, the addition of more HFE-7200 improves the extraction efficiency and decreases the drying time needed.

Another test was conducted using a decamethylcyclopentasiloxane/water/detergent mixture washed for 10 minutes and extracted at 1150 rpm for 7 minutes. The resulting retention was measured at 30.0%. An HFE-7200 rinse followed for 4 minutes, followed by the 1150 rpm extraction and followed by the above, described heated drying step. The retention and drying times were recorded and summarized below.

TABLE 2

| Load Size (kg) | LCR (Liters HFE/kg cloth) | Retention % | Dry Time (min) |
|---|---|---|---|
| 3.0 | 2.0 | 17.8 | 25 |
| 5.0 | 2.0 | 15.2 | 30 |
| 6.0 | 2.0 | 16.3 | 35 |

The interesting information from this chart shows that with a consistent volume of HFE-7200, the drying time is not greatly impacted by the size of the load. In a traditional aqueous wash in the same machine, a 3-kg load would take nearly 60 minutes, a 5-kg load 120 minutes and a 6-kg load almost 180 minutes.

Another test was conducted using a spray rinse technique. The fabric load was washed for 10 minutes in the decamethylcyclopentasiloxane/water/detergent mixture followed by a 1150 rpm, 7-minute extraction. HFE-7200 was added to the drum while the clothes were spinning at 300 rpm and the HFE-7200 was re-circulated through the load. A 1150-rpm, 7-minute extraction was completed along with the low temperature drying step described above. The retention and drying times are summarized and recorded below.

TABLE 3

| Load Size (kg) | LCR (Liters HFE/kg cloth) | Retention % | Dry Time (min) |
|---|---|---|---|
| 5.0 | 1.0 | 13.5 | 30 |
| 5.0 | 1.0 | 11.2 | 30 |

In this particular test, the amount of HFE needed has been even further reduced. This rinse method would allow for the most cost-effective solution to the consumer.

Additional experiments involving different working fluids and PRFs have been made. These tests confirm the data given above.

As stated above, the drying temperature for the above operations was around 60° C. In general, fabrics have a tendency to be damaged by temperatures exceeding 60° C. and most inlet air temperatures in traditional dryers may exceed 175° C. In traditional non-aqueous systems, the working fluids of choice usually have flashpoints lower than 100° C. In addition to the high flash points, these working fluids have low vapor pressures and they require higher temperatures for removal from the fabric. The National Fire Protection Association regulates the temperatures to which these working fluids may be heated to 17° C. below the flash point of the solvent.

In addition to temperature, the controller (discussed above) can also be connected to a humidity monitor for monitoring the humidity within the drum to detect an indication of the removal of a predetermined amount of moisture from the container. The controller is responsive to the detection of the removal of predetermined amount of moisture from the container to deactivate the heater in the drying loop.

While, all of the above data was compiled for temperatures that did not exceed 60° C. Additional tests indicate that depending upon energy requirements as well as time restrictions, the temperatures can be lowered further. The PRF removes most of the low vapor pressure working fluid and the use of the PRF with still high vapor pressure can lower drying temperatures still further and/or shorten drying times.

An additional requirement on the PRF is that the fluid is non-flammable. A non-flammable fluid combined with a flammable fluid increases the flash point of the solvent; thereby, increasing the safety associated with the system. The PRF will volatilize more quickly creating a PRF-rich head space above the working fluid; and this greatly reduces fire and explosion hazards due to the wash medium used. While most of the existing codes are set only for commercial machines, the ability to use this apparatus and method in the home can be more easily adapted with the select rinse fluid method. The select rinse fluid method as the capabilities of mitigating the risk associated with the use of cleaning with a flammable solvent.

In preferred embodiments, the working fluid will be selected for being non-aqueous and having the ability to remove soils and clean the fabrics. Such working fluids that fit the criteria are siloxanes and glycol ethers and more specifically decamethylcyclopentasiloxane, dipropylene glycol n-butyl ether, dipropylene glycol tertiary-butyl ether and/or tripropylene glycol methyl ether. Such a fluid will be added to a wash chamber after fabrics have been dispensed for cleaning. The system will run for a time sufficient to clean the fabrics while the working fluid and fabrics are tumbled at a rate sufficient to allow for the clothes to fall on top of one another. The working fluid will be removed from the fabrics through a spin that can range in speed from 600-1700 rpm based on the drum size used. The spin cycle will last for a time sufficient, greater than 2 minutes, where little or no additional working fluid is being removed from the fabrics. A select rinse fluid will be added to the system while the clothes are spinning at a rate of around 300 rpm. The select rinse fluid is selected for its ability to have a lower affinity for the fabrics than the working fluid as well as a lower osmotic force. More specifically, the PRF is a hydrofluoroether, either ethoxynonafluorobutane or methoxynonafluorobutane. The PRF is added while the fabrics are spinning thereby centrifugal force will pull the PRF through the fabrics removing a large portion of the working fluid. This action will take place for a time sufficient to reduce the concentration of working fluid to below 15% by weight of the fabric. The PRF and working fluid are removed by a conventional spinning cycle ranging from 600-1800 rpm. Heated air, preferably less than 80° C., is next introduced into the drum to remove the remaining PRF and working fluid from the fabric. Air is introduced while the fabrics are tumbling in the drum at a rate sufficient to allow air to transport solvent vapors from the surface of the fabrics into the air stream. This air stream is then passed over a condenser medium to remove most of the solvent vapors from the air stream so the air stream can pass over the fabrics again. After the fabrics are dry, they can be removed from the container.

The PRF and working fluid are then passed through a recovery system to separate and purify the fluids as much as possible. In the preferred embodiments, large particulates such as lint will be removed from the system. The recovery system will then pass into a distillation unit. It should be noted that the working fluid collected after the initial wash can be cleaned prior to introduction of the PRF. Most of these technologies have been discussed in U.S. 20040117919 and can be extended to glycol ether containing systems. The distillation unit will be heated to the boiling point of the PRF or to 30° F. below the flash point of the working fluid whichever is lower. The vapors created will be condensed and the PRF will be stored for re-use. The remaining working fluid will undergo a temperature reduction step to remove dissolved contaminants. The solution will pass through a cross-flow filtration membrane to concentrate the remaining contaminants in a smaller volume of working fluid. This concentrated solution will pass through an additional filtration means whereby the remaining working fluid can be evaporated, condensed and then re-used. The non-concentrated stream will pass through a series of adsorption/absorption filters to remove remaining contaminants and then through a sanitizing operation. The contaminants removed from the system will be collected and either discarded after each cycle or collected for a series of cycles and then discarded.

The preferred apparatus for such an operation should contain a myriad of components and can be modular in nature if need be. The apparatus should contain storage containers for the working fluid as well as the select rinse fluid. The apparatus should contain a drum or container for depositing clothes a means for controlling the drum such as a motor, a means for dispensing the working fluid, PRF, washing additives and the likes into the wash chamber, a blower to move air for drying, a heating means for heating the air, the fluids, the fabrics or the drum, a condensing means to remove the solvent vapors from the air stream, a means to add mechanical energy to the drum, means for sensing and a means for recovery.

In a preferred embodiment, the apparatus would be constructed in a manner where the size wouldn't require modifications to place the unit within the home. Additionally, this unit can be constructed and arranged in such a manner to operate as a dual fluid machine (aqueous-based cycles as well as non-aqueous cycles).

In the select rinse fluid (PRF) process of the present invention, it has been accomplished stages of separating the working fluid from the fibers in a series of steps.

The working fluids that are best suited for cleaning all fabrics still have some disadvantages. Most of these fluids have extremely small vapor pressures and generally have flash points. This makes conventional drying processes rather difficult. Select rinse fluids that are miscible with these working fluids can be added during one of the rinses and can remove a substantial amount of the remaining working fluid. These select rinse fluids can then be more easily removed via traditional convection drying processes.

The invention does not stop here; however, in that effective ways of recovery of the PRF are provided. In the preferred embodiments, a combination of working fluids and PRF are selected which are miscible and very different in ways which permit the two to be separated by ways which can be accomplished in simple operations which lend themselves to a complete cycle, which can be performed in the automatic, self-contained non-aqueous laundering machine described.

We claim:

1. An automatic laundering apparatus comprising:

a wash chamber for containing fabrics;

a drying loop in fluid communication with the wash chamber, the drying loop comprising a heater and a condenser system;

wherein the condenser system comprises a first condenser unit and a second condenser unit disposed between the wash chamber and the heater; and wherein the condenser system receives multiple fluids and preferentially separates the multiple fluids to produce a first condensate fluid and a second condensate fluid that is different than the first condensate fluid, in the drying loop.

2. The apparatus of claim 1, wherein the drying loop of the apparatus comprises:

a wash chamber conduit disposed between the heater and a plurality of wash chamber inlets of a wash chamber.

3. The apparatus of claim 1 wherein the apparatus further comprises a dispenser system for dispensing at least one washing additive at a pre-selected time period during the wash cycle.

4. The apparatus of claim 1 wherein the apparatus further comprises a means for storing a select rinse fluid and a means for introducing a select rinse fluid at a pre-selected time period during a wash cycle.

5. The apparatus of claim 1 wherein the drying loop further comprises an activation device which controls the temperature such that the fabric fibers will not exceed a prolonged temperature above 140 degrees F.

6. The apparatus of claim 1 wherein the apparatus a recovery system.

7. The apparatus of claim 1, wherein the first condenser unit comprises individual plates and the second condenser unit comprises individual plates.

8. The apparatus of claim 7, wherein the individual plates of the first condenser unit are oriented at an angle and the individual plates of the second condenser unit are oriented at an angle.

9. The apparatus of claim 1, further comprising:

a condenser pan; and a condenser sump connected to the condenser pan.

10. The apparatus of claim 1, further comprising a condenser sump in fluid communication with the condenser system.

11. An apparatus for non-aqueous laundering of fabrics comprising:

a wash chamber to hold fabric;

a first storage and dispensing system for storing a working fluid and for selectively dispensing said working fluid into the wash chamber;

a second storage and dispensing system for storing a rinse fluid and for selectively dispensing said rinse fluid into the wash chamber;

a recovery system in fluid communication with the wash chamber;

a drying loop comprising a condenser system disposed between the wash chamber and the heater; and wherein the condenser system comprises a first condenser unit comprising individual plates and a second condenser unit comprising individual plates, the first condenser unit and the second condenser unit disposed inside a condenser body, wherein the first condenser unit produces a first condensate fluid and the second condenser unit produces a second condensate fluid which is different than the first fluid.

12. The apparatus of claim 11 wherein the apparatus is chemically compatible with said working fluid, wherein the working fluid is selected from the group consisting of: terpenes, halohydrocarbons, glycol ethers, polyols, ethers, esters of glycol ethers, esters of fatty acids and other long chain carboxylic acids, fatty alcohols and other long chain alcohols, short-chain alcohols, polar aprotic solvents, siloxanes, hydrofluoroethers, dibasic esters, aliphatic hydrocarbons and combinations thereof.

13. The apparatus of claim 12 wherein the apparatus is chemically compatible with said working fluid selected from the group consisting of: decamethylcyclopentasiloxane, dodecamethylpentasiloxane, octamethylcyclotetrasiloxane, decamethyltetrasiloxane, dipropylene glycol n-butyl ether (DPnB), dipropylene glycol n-propyl ether (DPnP), dipropylene glycol tertiary-butyl ether (DPtB), propylene glycol n-butyl ether (PnB), propylene glycol n-propyl ether (PnP), tripropylene methyl ether (TPM) and/or combinations thereof.

14. The apparatus of claim 11 wherein the apparatus is chemically compatible with said rinse fluid, that has at least one of the following Hanson Solubility Parameters: (a) a polarity greater than 3 and hydrogen bonding less than 9; (b) hydrogen bonding less than 13 and dispersion from 14 to 17; and (c) hydrogen bonding from 13 to 19 and dispersion from 14 to 22.

15. The apparatus of claim 11 further comprising a two-way valve adapted for re-circulating said working fluid and said rinse fluid from the wash chamber through said first and second storage and dispensing systems.

16. The apparatus of claim 11 wherein said first and second storage and dispensing further comprise a mechanical pump adapted to pump fluid into said container.

17. The apparatus of claim 11 further comprising a non-mechanical pump.

18. The apparatus of claim 17 wherein said non-mechanical pump is selected from at least one of the following: piezoelectric, electrohydrodynamic, thermal bubble, magnetohydrodynamic and electroosmotic pumps.

19. The apparatus of claim 11 further comprising a heating system selectively operable for heating fluid in the fabric in the container.

20. The apparatus of claim 19 wherein the heating system is an electric coil heater.

21. The apparatus of claim 11 further comprising a controller constructed and arranged to regulate cycle times and fluid usage; and wherein said controller causes said condenser to condense the select rinse fluid, an added water and the working fluid at separate distinctive preselected times.

22. The apparatus of claim 11 wherein said wash chamber comprises a horizontal axis laundry apparatus.

23. The apparatus of claim 11 wherein said wash chamber comprises a vertical axis laundry apparatus.

24. The apparatus of claim 11, wherein the individual plates of the first condenser unit are oriented at an angle and the individual plates of the second condenser unit are oriented at an angle.

25. The apparatus of claim 11, further comprising a condenser sump in fluid communication with the condenser system.

26. An apparatus for laundering fabrics comprising:

a wash chamber to hold fabric;

a first storage and delivery system for storing a working fluid and selectively delivering the working fluid to the wash chamber;

a second storage and delivery system for storing a rinse fluid and selectively delivering the rinse fluid to the wash chamber;

a drying loop comprising a condenser system disposed between the heater and the wash chamber, and a condenser sump in fluid communication with the condenser system; and wherein the condenser system comprises a condenser body, and a first condenser unit and a second condenser unit inside the body; and wherein the condenser system condenses vapors of a mixture of the working fluid and the rinse fluid, and the first condenser unit produces a first condensate fluid and the second condenser unit produces a second condensate different than the first condensate.

27. The apparatus of claim 26 wherein the condenser system removes some of the working fluid and select rinse fluid vapor.

28. The apparatus for laundering fabrics of claim 26 further comprising a temperature sensor detecting a characteristic indicative of the temperature of the fabric; and further wherein said controller is responsive to said temperature sensor to regulate said heater so as to selectively elevate the temperature of the fabric to a temperature wherein fluid evaporates from the fabric.

29. The apparatus of claim 26 wherein the apparatus further comprises the control means that maintains the temperature of the heater such that the temperature of the fabric does not exceed the lower of 140. degree F. or 30 degree F. below the flash point of the working fluid.

30. The apparatus of claim 26 further comprising a humidity monitor for monitoring the humidity within the drum to detect an indication of the removal of a predetermined amount of moisture from the container, said controller being responsive to said detection of the removal of predetermined amount of moisture from the container to deactivate the heater.

31. The apparatus of claim 26 wherein the condenser system is at least one of the following: a multiple chamber condenser unit, a direct spray condenser, a radiator condenser system, a fin-tube condenser, a bubble condensation system, a condenser with thermoelectric coolers, a condenser with peltier elements, and a condenser with thermo-acoustic and membrane technologies.

32. The apparatus of claim 26 wherein the drying loop further includes a heater and at least one wash chamber conduit connected to at least two wash chamber inlets.

33. The apparatus of claim 32 wherein the at least two wash chamber inlets are connected to one apparatus for laundering fabrics.

34. The apparatus of claim 26, wherein the first condenser unit comprises individual plates and the second condenser unit comprises individual plates.

35. The apparatus of claim 34, wherein the individual plates of the first condenser unit are oriented at an angle and the individual plates of the second condenser unit are oriented at an angle.

36. The apparatus of claim 26, wherein the condenser sump is in fluid communication with the wash chamber.

* * * * *